US008807680B2

(12) United States Patent
Takagi

(10) Patent No.: US 8,807,680 B2
(45) Date of Patent: Aug. 19, 2014

(54) METHOD AND DRIVE CIRCUIT FOR DRIVING PIEZOELECTRIC ELEMENT, AND LIQUID-DROPLET EJECTION HEAD

(75) Inventor: Izumi Takagi, Kuwana (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 215 days.

(21) Appl. No.: 13/434,650

(22) Filed: Mar. 29, 2012

(65) Prior Publication Data

US 2012/0327150 A1 Dec. 27, 2012

(30) Foreign Application Priority Data

Jun. 24, 2011 (JP) ..... 2011-140982

(51) Int. Cl.
*B41J 29/38* (2006.01)
*B41J 2/045* (2006.01)

(52) U.S. Cl.
CPC ..... *B41J 29/38* (2013.01); *B41J 2/04581* (2013.01); *B41J 2/04588* (2013.01)
USPC ..... 347/10; 347/11; 347/12

(58) Field of Classification Search
CPC ..... B41J 29/38; B41J 2/04581; B41J 2/04588
USPC ..... 347/10–12
See application file for complete search history.

(56) References Cited

U.S. PATENT DOCUMENTS

2012/0249645 A1* 10/2012 Kyoutani ..... 347/14

FOREIGN PATENT DOCUMENTS

JP 2007-131009 A 5/2007
JP 2008-132657 A 6/2008

* cited by examiner

*Primary Examiner* — Jason Uhlenhake
(74) *Attorney, Agent, or Firm* — Merchant & Gould PC

(57) ABSTRACT

A method for driving a piezoelectric element of a head, including: a step of increasing a voltage of a power source to a reference voltage level; and a step of charging one electrode of two electrodes interposing the piezoelectric element to the reference voltage level by repeating source-connections and source-disconnections between the power source and the one electrode while keeping the voltage of the power source at the reference voltage level, such that a ratio of a connection time of each of at least one of second and subsequent connections of the source-connections to a disconnection time of a corresponding source-disconnection continued from each of the at least one of the second and subsequent connections is greater than a ratio of a connection time of a first connection of the source-connections to a disconnection time of a source-disconnection continued from the first connection.

20 Claims, 14 Drawing Sheets

METHOD AND DRIVE CIRCUIT FOR DRIVING PIEZOELECTRIC ELEMENT, AND LIQUID-DROPLET EJECTION HEAD

CROSS REFERENCE TO RELATED APPLICATION

The present application claims priority from Japanese Patent Application No. 2011-140982, which was filed on Jun. 24, 2011, the disclosure of which is herein incorporated by reference in its entirety.

BACKGROUND OF THE INVENTION

1. Field of the Invention

The present invention relates to a method and a drive circuit for driving a piezoelectric element, and a liquid-droplet ejection head. More specifically, the present invention relates to a liquid-droplet ejection head, and a method and a drive circuit for driving the liquid-droplet ejection head configured to apply a drive voltage to a piezoelectric element to eject a liquid droplet.

2. Description of the Related Art

There is conventionally known a liquid-droplet ejection head having a piezoelectric element that is mechanically distorted by a voltage application. In general, such a liquid-droplet ejection head is configured to apply a drive voltage to the piezoelectric element to apply a pressure to liquid in a pressure chamber by changing a volume of the pressure chamber filled with the liquid such as ink, thereby ejecting a liquid droplet from a distal end of a nozzle communicating with the pressure chamber.

The piezoelectric element has an electrostatic capacity like a condenser. When an interelectrode voltage of the piezoelectric element (an amount of electric charge charged to the piezoelectric element) is abruptly changed, the liquid may be ejected erroneously from the nozzle. For example, when a drive voltage is suddenly applied to a piezoelectric element whose interelectrode voltage has been lowered by self-discharge, an internal pressure of the pressure chamber changes considerably by the sudden change of the interelectrode voltage of the piezoelectric element, which may cause the misejection of the liquid droplet from the nozzle.

In order to solve this problem, one conventional technique is designed such that the piezoelectric element is gradually charged and discharged upon electric charge and discharge of the piezoelectric element to prevent the sudden change of the interelectrode voltage of the piezoelectric element. FIG. 15 shows one conventional example of a timing chart of a source voltage and drive signals upon the electric charge and discharge of the piezoelectric element. As shown in FIG. 15, upon the electric charge of the piezoelectric element, a driver source voltage (i.e., a HVDD voltage) is changed from a ground level to a reference voltage level over several tens ms in a state in which the driver is set so as to apply the drive voltage to the piezoelectric element (hereinafter may be referred to as "driver ON state"), thereby gradually increasing the interelectrode voltage of the piezoelectric element. Further, as shown in FIG. 15, upon the electric discharge of the piezoelectric element, the driver source voltage is changed from the reference voltage level to the ground level over several hundreds ms in the driver ON state, thereby gradually reducing the interelectrode voltage of the piezoelectric element.

In one conventional technique, in order to prevent the sudden change of the interelectrode voltage of the piezoelectric element upon the electric charge and discharge, one electrode of the piezoelectric element is connected to a power source of the reference voltage level at several times upon the electric charge. That is, the voltage is intermittently applied to the electrode of the piezoelectric element to charge the one electrode of the piezoelectric element stepwise. Upon the electric discharge, the one electrode of the piezoelectric element is connected to a ground at several times. That is, the one electrode of the piezoelectric element is intermittently grounded to discharge electric charge accumulated in the piezoelectric element stepwise.

SUMMARY OF THE INVENTION

FIGS. 16A and 16B are views for explaining the stepwise electric charge of the piezoelectric element by the intermittent application of the voltage to the electrode of the piezoelectric element according to the conventional technique, wherein FIG. 16A is a timing chart showing a charge and discharge waveform, and FIG. 16B is a view corresponding to this charge and discharge waveform and showing a time change of the interelectrode voltage of the piezoelectric element. As shown in these figures, both of a pulse frequency and a pulse width (i.e., a duty ratio) of the charge waveform are constant, and a rise portion of the interelectrode voltage (a time area in which an electric potential abruptly increases) and a nonrise portion of the interelectrode voltage (a time area in which the electric potential hardly increases) appear for each pulse in the time change of the interelectrode voltage. An inclination of the rise portion is the sharpest in a first pulse, and the inclination decreases with subsequent pulses. In other words, the inclination of the rise portion in the curve representing the change in the interelectrode voltage decreases with latter pulses. If the interelectrode voltage is changed in this manner, the piezoelectric element is gradually charged, making it possible to prevent the abrupt change of the interelectrode voltage. However, the frequent electric charges take a long time for the interelectrode voltage of the piezoelectric element to reach the reference voltage level, resulting in poor control of driving the piezoelectric element.

This invention has been developed to provide a method and a drive circuit for driving a piezoelectric element, and a liquid-droplet ejection head, capable of preventing sudden change of an interelectrode voltage of the piezoelectric element while shortening a time required for electric charge and discharge of the piezoelectric element.

The present invention provides a method for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the method including: a first step of increasing a voltage of a power source to a reference voltage level; and a second step of charging one electrode of the two electrodes to the reference voltage level by repeating a plurality of source-connections and a plurality of source-disconnections between the power source and the one electrode while keeping the voltage of the power source at the reference voltage level, such that a ratio of a connection time of each of at least one of second and subsequent connections of the plurality of source-connections to a disconnection time of a corresponding one of at least one of the plurality of source-disconnections which one is continued from said each of the at least one of the second and subsequent connections is greater than a ratio of a connection time of a first connection of the plurality of source-connections to a disconnection time of a disconnection of the plurality of source-disconnections which is continued from the first connection.

The present invention also provides a drive circuit for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the drive circuit including: a first switch element configured to connect one electrode of the two electrodes to a power source of a reference voltage level when a first drive signal is ON and configured to disconnect the one electrode from the power source when the first drive signal is OFF; and a charge controller configured to generate the first drive signal for charging the one electrode to the reference voltage level by repeating a plurality of source-connections and a plurality of source-disconnections between the power source and the one electrode such that a ratio of a connection time of each of at least one of second and subsequent connections of the plurality of source-connections to a disconnection time of a corresponding one of the plurality of source-disconnections which is continued from said each of the at least one of the second and subsequent connections is greater than a ratio of a connection time of a first connection of the plurality of source-connections to a disconnection time of a disconnection of the plurality of source-disconnections which is continued from the first connection, the charge controller being configured to transmit the generated first drive signal to the first switch element.

The present invention also provides a drive circuit for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the drive circuit including: a third switch element configured to connect one electrode of the two electrodes to a power source of a reference voltage level when a drive signal is ON and configured to connect the one electrode to a ground when the drive signal is OFF; and a charge controller configured to generate the drive signal for charging the one electrode to the reference voltage level by repeating a plurality of source-connections between the power source and the one electrode and a plurality of ground-connections between the ground and the one electrode such that a ratio of a connection time of each of at least one of second and subsequent connections of the plurality of source-connections to a connection time of a corresponding one connection of the plurality of ground-connections which is continued from said each of the at least one of the second and subsequent connections is greater than a ratio of a connection time of a first connection of the plurality of source-connections to a connection time of a connection of the plurality of ground-connections which is continued from the first connection, the charge controller being configured to transmit the generated drive signal to the third switch element.

The present invention also provides a drive circuit for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the drive circuit including: a switch element configured to connect one electrode of the two electrodes to a power source of a reference voltage level when a drive signal is ON; a charge controller configured to generate the drive signal for charging the one electrode to the reference voltage level and to transmit the generated drive signal to the switch element; a first resistance changeable between (i) a first limitation state in which the first resistance limits a flow of a current from the power source to the one electrode and (ii) a first limitation release state in which the limitation is released; and a first resistance switch portion configured to establish the first limitation state of the first resistance upon a start of an electric charge of the piezoelectric element and then change the first resistance from the first limitation state to the first limitation release state after a predetermined time has passed from the start of the electric charge.

The present invention also provides a drive circuit for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the drive circuit including: a switch element configured to connect one electrode of the two electrodes to a power source of a reference voltage level when a drive signal is ON; a charge controller configured to generate the drive signal for charging the one electrode to the reference voltage level and to transmit the generated drive signal to the switch element; a first resistance changeable between (i) a first limitation state in which the first resistance limits a flow of a current from the power source to the one electrode and (ii) a first limitation release state in which the limitation is released; and a third resistance switch portion configured to establish the first limitation release state of the first resistance upon a start of an electric charge of the piezoelectric element and then change the first resistance from the first limitation release state to the first limitation state after a predetermined time has passed from the start of the electric charge.

The present invention also provides a method for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the method including: a step of discharging one electrode of the two electrodes which is charged to a reference voltage level to a ground level by repeating a plurality of ground-connections and a plurality of ground-disconnections between the one electrode and a ground such that a ratio of a connection time of each of at least one of second and subsequent connections of the plurality of ground-connections to a disconnection time of a corresponding one of the plurality of ground-disconnections which is continued from said each of the at least one of the second and subsequent connections is greater than a ratio of a connection time of a first connection of the plurality of ground-connections to a disconnection time of a disconnection of the plurality of ground-disconnections which is continued from the first connection.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which:

FIGS. 16A and 16B are views for explaining stepwise electric charge of the piezoelectric element by intermittent application of a voltage into an electrode of the piezoelectric element according to the conventional technique, wherein FIG. 16A is a timing chart showing a charge and discharge waveform, and FIG. 16B is a view corresponding to this charge and discharge waveform and showing a time change of an interelectrode voltage of the piezoelectric element.

DETAILED DESCRIPTION OF THE EMBODIMENTS

Figure 1:
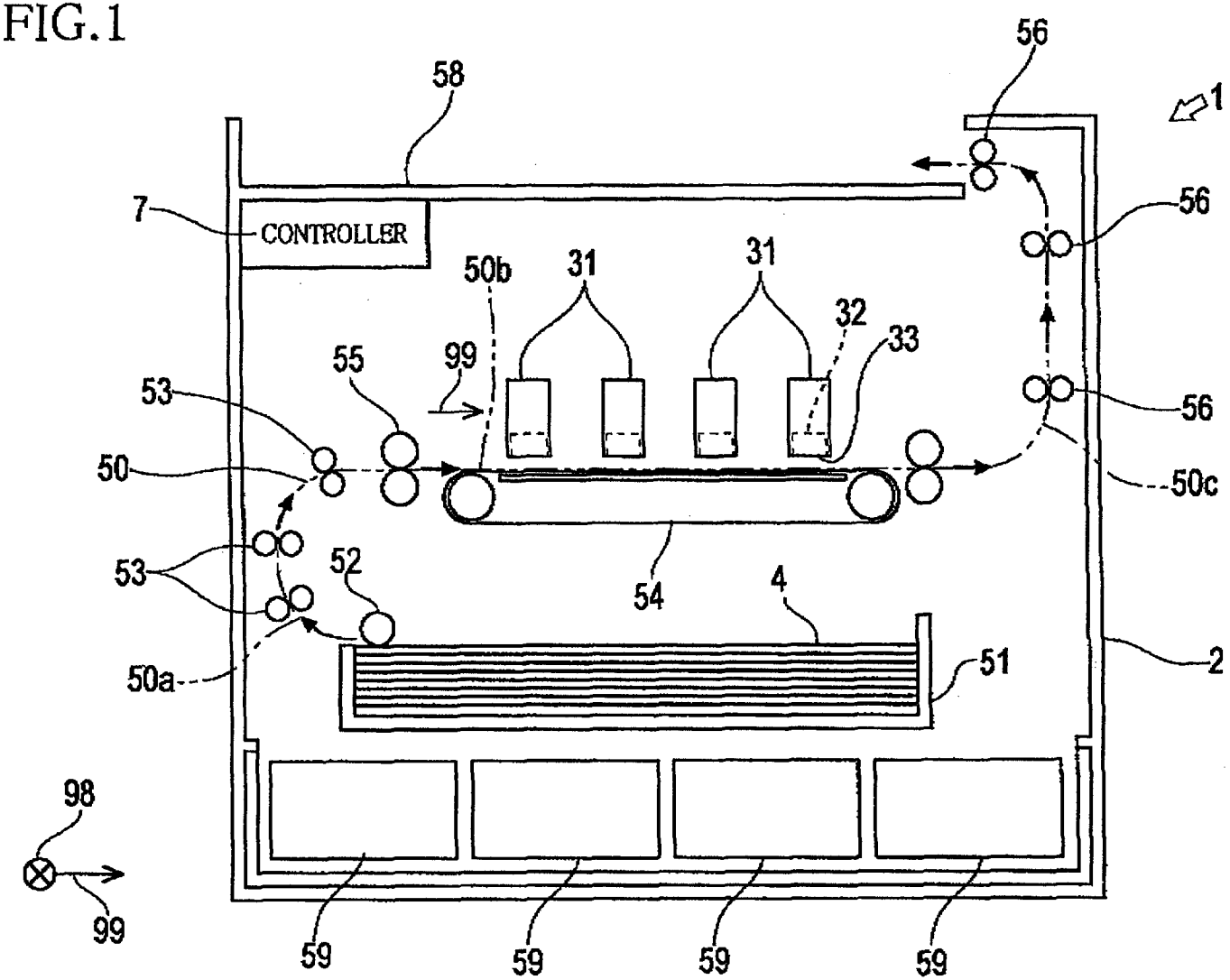
FIG. 1 is a side view generally showing an overall construction of an ink-jet printer as one embodiment of the present invention.

Hereinafter, there will be described embodiments of the present invention by reference to the drawings. In the following explanation, the present invention is applied to an ink jet printer as one example of a liquid-droplet ejection apparatus to which the present invention is applied. It is noted that the same reference numerals are used in all the drawings to designate the same or corresponding elements, and an overlapping explanation is omitted.

First Embodiment

As shown in FIG. 1, a printer 1 as one example of the present embodiment includes a housing 2 having a generally rectangular parallelepiped shape. In the housing 2 is formed a conveyance path 50 through which a recording sheet 4 is conveyed. Provided in this housing 2 are: a sheet-supply tray 51 for accommodating the recording sheet(s) 4 to be supplied to the conveyance path 50; one or a plurality of ink ejection heads (liquid-droplet ejection heads) 31 each configured to eject ink droplets (liquid droplets) onto the recording sheet 4 conveyed through the conveyance path 50; a plurality of ink tanks 59 each for storing ink (liquid) to be supplied to a corresponding one of the ink ejection heads 31; a controller 7 for controlling operations of the printer 1; and so on.

As indicated by bold arrows in FIG. 1, the conveyance path 50 extends from the sheet-supply tray 51 to a sheet-discharge portion 58 provided on an upper face of the housing 2 so as to have an S shape inverted in a rightward and leftward direction as a whole. The conveyance path 50 includes continuous three paths, namely, a sheet-supply path 50*a*, a recording path 50*b*, and a sheet-discharge path 50*c*. A sheet-supply roller 52 is provided at a start point of the conveyance path 50, at which the sheet-supply roller 52 is rotated to supply the recording sheet 4 from the sheet-supply tray 51 to the sheet-supply path 50*a*. In the sheet-supply path 50*a*, a plurality of conveyance rollers 53 are rotated to convey the recording sheet 4 through the sheet-supply path 50*a* from its upstream side to its downstream side. A register roller (registration roller) 55 is provided in a downstream portion of the sheet-supply path 50*a*. This register roller 55 makes a posture (inclination) of the recording sheet 4 in order, and then this recording sheet 4 enters into the recording path 50*b*. The recording path 50*b* is formed mainly by an endless belt 54. The endless belt 54 can convey the recording sheet 4 generally horizontally in a sheet conveyance direction 99 (see FIG. 1) while attracting the recording sheet 4 on a face of the endless belt 54. In the sheet-discharge path 50*c* continued from the recording path 50*b*, a plurality of sheet-discharge rollers 56 are rotated to convey the recording sheet 4 through the sheet-discharge path 50*c* from its upstream side to its downstream side, and finally the recording sheet 4 is discharged onto the sheet-discharge portion 58.

The four ink ejection heads 31 respectively for ejecting black, cyan, magenta, and yellow inks are provided over the endless belt 54 partly defining the recording path 50*b* so as to be arranged along the recording path 50*b*. Specifically, the four ink-ejection heads 31 are arranged from an upstream side to a downstream side in the sheet conveyance direction 99 in ascending order of brightness of the ink to be ejected therefrom, namely, in order of the black ink, the cyan ink, the magenta ink, and the yellow ink.

Figure 2:
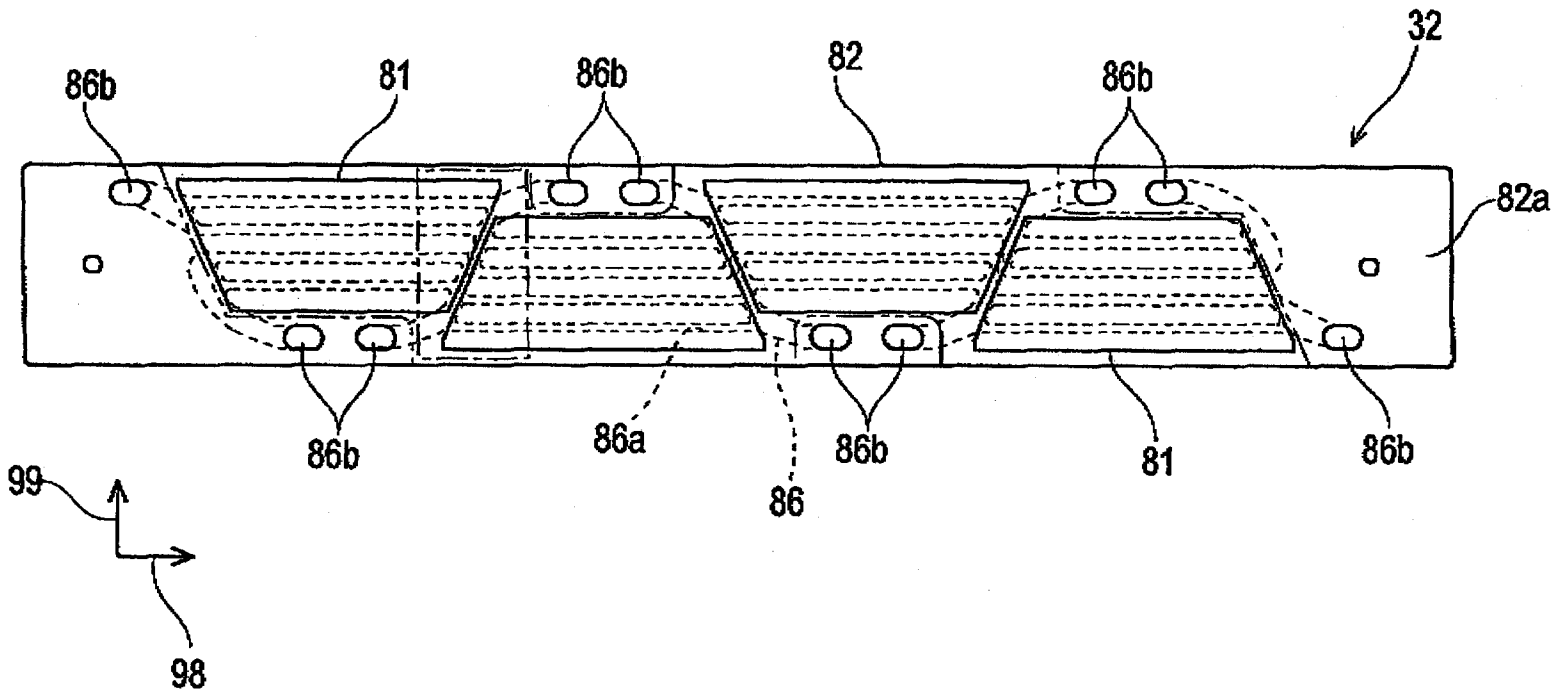
FIG. 2 is a plane view showing a head main body.
Figure 3:
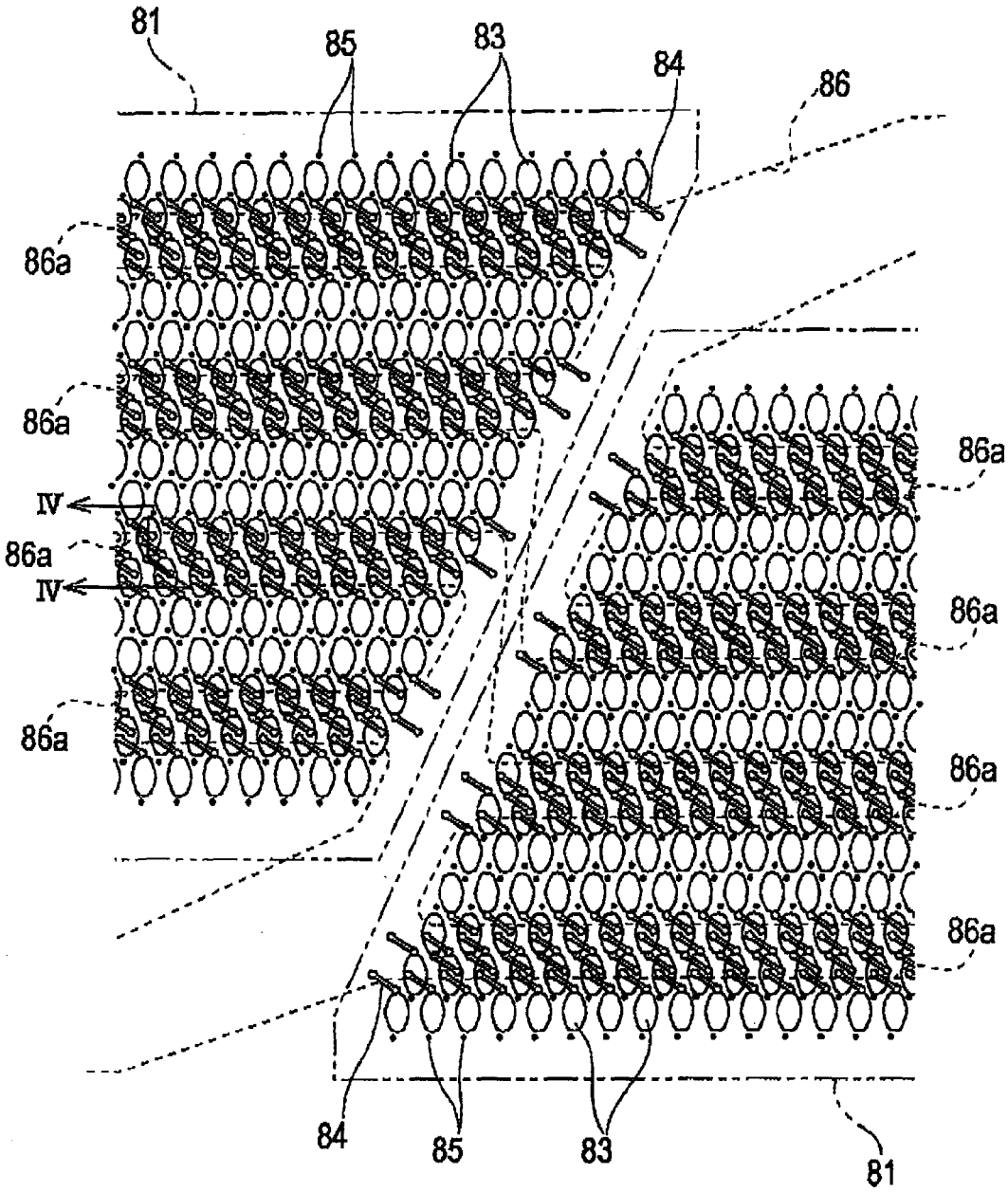
FIG. 3 is an enlarged view showing an area enclosed by one-dot chain line in FIG. 2.
Figure 4:
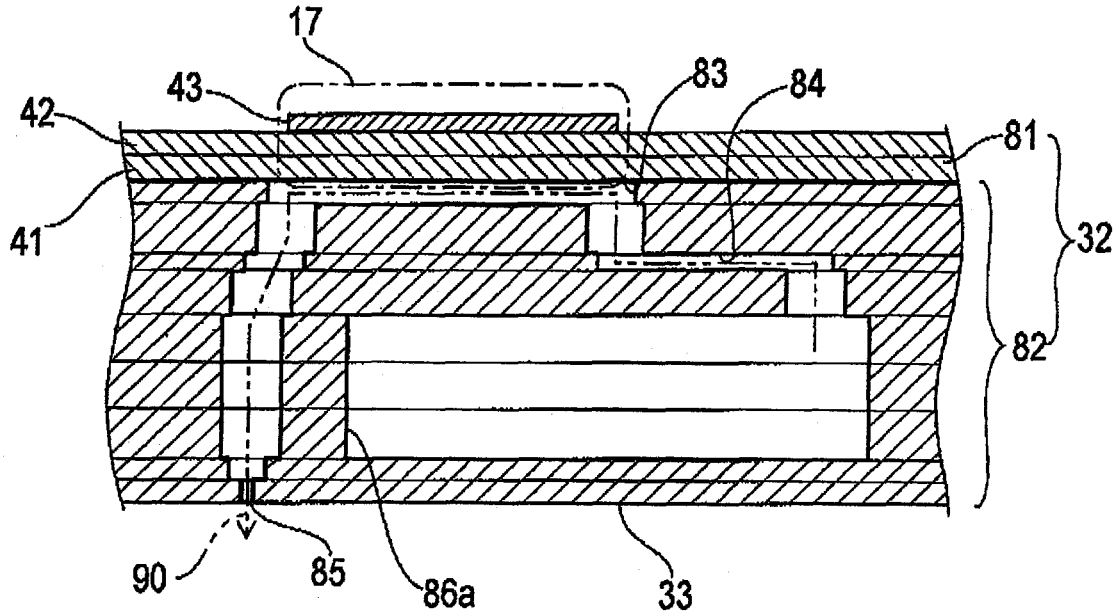
FIG. 4 is a cross-sectional view taken along line IV-IV in FIG. 3.

The four ink ejection heads 31 have generally the same structure. Thus, the following explanation will be given for one head 31 for the sake of simplicity unless otherwise required by context. The head 31 is a line head having a generally rectangular parallelepiped shape elongated in a sheet width direction 98. Here, the sheet width direction 98 is a direction perpendicular to the sheet conveyance direction 99 and along a horizontal plane. The ink ejection head 31 includes a head main body 32 having a multiplicity of ejection openings 85 (see FIGS. 3 and 4) formed therein. The ejection openings 85 open in an ejection face 33 that is a lower face of the ink ejection head 31. The ejection face 33 faces the recording sheet 4 conveyed through the recording path 50*b*, with a predetermined distance therebetween in an up and down direction. There will be next explained the structure of the ink ejection head 31 with reference to FIGS. 2-4. It is noted that, in FIG. 3, pressure chambers 83, apertures 84, and the ejection openings 85 are illustrated by solid lines for easier understanding purposes though these elements are located under actuator units 81 and thus should be illustrated by broken lines.

The head main body 32 of the ink ejection head 31 is constituted by a channel unit 82 and a plurality of the actuator units 81 (four actuator units 81 in the present embodiment). The channel unit 82 has a multiplicity of individual ink channels 90 each extending from a corresponding one of manifolds 86 each functioning as a common liquid chamber to a corresponding one of the ejection openings 85. The actuator units 81 are fixed to an upper face 82*a* of the channel unit 82. It is noted that, though not shown, the ink ejection head 31 includes not only the head main body 32 but also a reservoir unit for storing the ink to be supplied to the channel unit 82, a flexible printed circuit (FPC) for supplying drive signals to the actuator units 81, and a control board for controlling driver circuits 11 mounted on the respective FPC.

The channel unit 82 will be explained. The channel unit 82 is a stacked body including a plurality of metal plates (each formed of stainless steel) stacked and positioned on one another. Ink supply openings 86*b* are opened in the upper face 82*a* of the channel unit 82. Each of the ink supply openings 86*b* corresponds to one of ink outlet channels of the reservoir unit and communicates with one end of a corresponding one of the manifolds 86. A lower face of the channel unit 82 is the ejection face 33 having the multiplicity of the ejection openings 85 arranged in matrix. The multiplicity of individual ink channels 90 are formed in the channel unit 82. Each of the individual ink channels 90 extends, from a corresponding one of the manifolds 86 to a corresponding one of sub-manifolds 86*a* and then from an outlet of the corresponding sub-manifold 86*a* to a corresponding one of the ejection openings 85 via a corresponding one of the apertures 84 and a corresponding one of the pressure chambers 83.

Next, the actuator units 81 will be explained. Each of the actuator units 81 includes a multiplicity of actuators (ejection-energy application portions) respectively corresponding to the pressure chambers 83. One or more of the actuators are selectively operated, and thereby an ejection energy is applied to the ink in each pressure chamber 83 corresponding to one of the actuator(s). The present embodiment employs a piezoelectric actuator including stacked-type piezoelectric elements 17 as the actuators. Thus, the actuators may be hereinafter referred to as "piezoelectric elements 17".

Each of the actuator units 81 includes a vibration plate 41, a piezoelectric layer 42, and a multiplicity of individual electrodes 43. The vibration plate 41 is formed of metal material such as stainless steel and bonded to an upper face of the channel unit 82 so as to cover and seal upper openings of the respective pressure chambers 83. The vibration plate 41 having conductivity also functions as a common electrode for generating a potential difference between the vibration plate 41 and the individual electrodes 43. The vibration plate 41 is always held at a ground electric potential.

The piezoelectric layer 42 is formed of a piezoelectric material mainly composed of lead zirconate titanate that is a mixed crystal of lead titanate and zirconate titanate. The piezoelectric layer 42 is disposed on an upper face of the vibration plate 41 so as to continuously expanding over the pressure chambers 83.

Each of the individual electrodes 43 has a planar shape one size smaller than that of a corresponding one of the pressure chambers 83. Each individual electrode 43 is disposed on an upper face of the piezoelectric layer 42 at a position opposite to a generally central portion of the corresponding pressure chamber 83. Portions of the piezoelectric layer 42 which are interposed between the individual electrodes 43 and the vibration plate 41 as the common electrode are polarized downward in its thickness direction. A connection terminal, not shown, is integrally formed on each individual electrode 43. This connection terminal is connected to the FPC, not shown, and to the driver circuit 11 (see FIG. 5) via the FPC. As will be described below, in order to land the ink on the recording sheet 4 to form one dot, the driver circuit 11 applies a drive waveform signal constituted by one or a plurality of drive pulses, to the individual electrode 43 according to a size of the dot to be formed.

In each actuator unit 81, portions thereof opposed to the respective pressure chambers 83 (enclosed by one-dot chain line in FIG. 4) function respectively as the actuators (the piezoelectric elements 17) for applying pressures to the ink in the respective pressure chambers 83. That is, the piezoelectric elements 17 are provided respectively for the pressure chambers 83 (i.e., the ejection openings 85).

Here, there will be explained a method for driving each piezoelectric element 17 of the actuator unit 81. It is noted that the following explanation will be given for one piezoelectric element 17 for the sake of simplicity unless otherwise required by context. In the piezoelectric element 17, an interelectrode voltage of the individual electrode 43 is increased from a ground level to a predetermined drive voltage V1. When the interelectrode voltage of the individual electrode 43 becomes the predetermined drive voltage V1, a potential difference is established between the individual electrode 43 and the vibration plate 41 as the common electrode, whereby a downward electric field (whose direction coincides with the polarization direction) is generated at a portion of the piezoelectric layer 42 which is interposed between these electrodes. This electric field contracts this portion of the piezoelectric layer 42 in a horizontal direction perpendicular to a thickness direction of the piezoelectric layer 42, whereby portions of the vibration plate 41 and the piezoelectric layer 42 which are opposed to the pressure chamber 83 are deformed as a whole so as to project toward the pressure chamber 83. As a result, a volume of the pressure chamber 83 is reduced. The drive pulse for ejecting the ink are then applied to the individual electrode 43 in this state. This drive pulse is a pulse that temporarily changes the interelectrode voltage of the individual electrode 43 from the drive voltage V1 to the ground level to temporarily increase the volume of the pressure chamber 83 and then returns the interelectrode voltage of the individual electrode 43 from the ground level to the drive voltage V1 at a predetermined timing to reduce the volume of the pressure chamber 83. This driving method is what is called a "fill-before-fire" method in which the interelectrode voltage of the individual electrode 43 is temporarily changed from the drive voltage V1 to the ground level to generate a pressure wave of a negative pressure in the pressure chamber 83, and then the interelectrode voltage of the individual electrode 43 is returned from the ground level to the drive voltage V1 so as to reduce the volume of the pressure chamber 83 at a timing when this pressure wave is returned as a pressure wave of a positive pressure to a position at which the pressure is applied to the pressure chamber. This makes it possible to generate a greater ejection energy to be applied to the ink even where a change of the volume of the pressure chamber 83 is relatively small. This application of the pressure to the ink in the pressure chamber 83 applies the ejection energy to the ink, causing an ink droplet to be ejected from the ejection opening 85 communicating with the pressure chamber 83. Thereafter, when the interelectrode voltage of the individual electrode 43 is returned to the drive voltage V1, an ejection preparation state in which the piezoelectric element 17 is deformed is reestablished. In this operation, the above-described ink ejecting operation(s) are performed according to the number of the drive pulses successively applied from the driver circuit 11 to the individual electrode 43, and the ink droplet(s) are ejected from the ejection opening. For example, where two drive pulses are successively applied from the driver circuit 11 to the individual electrode 43, two ejecting operations are performed in which two ink droplets are successively ejected from the pressure chamber 83 and landed on the recording sheet 4, whereby one dot is formed.

Figure 5:
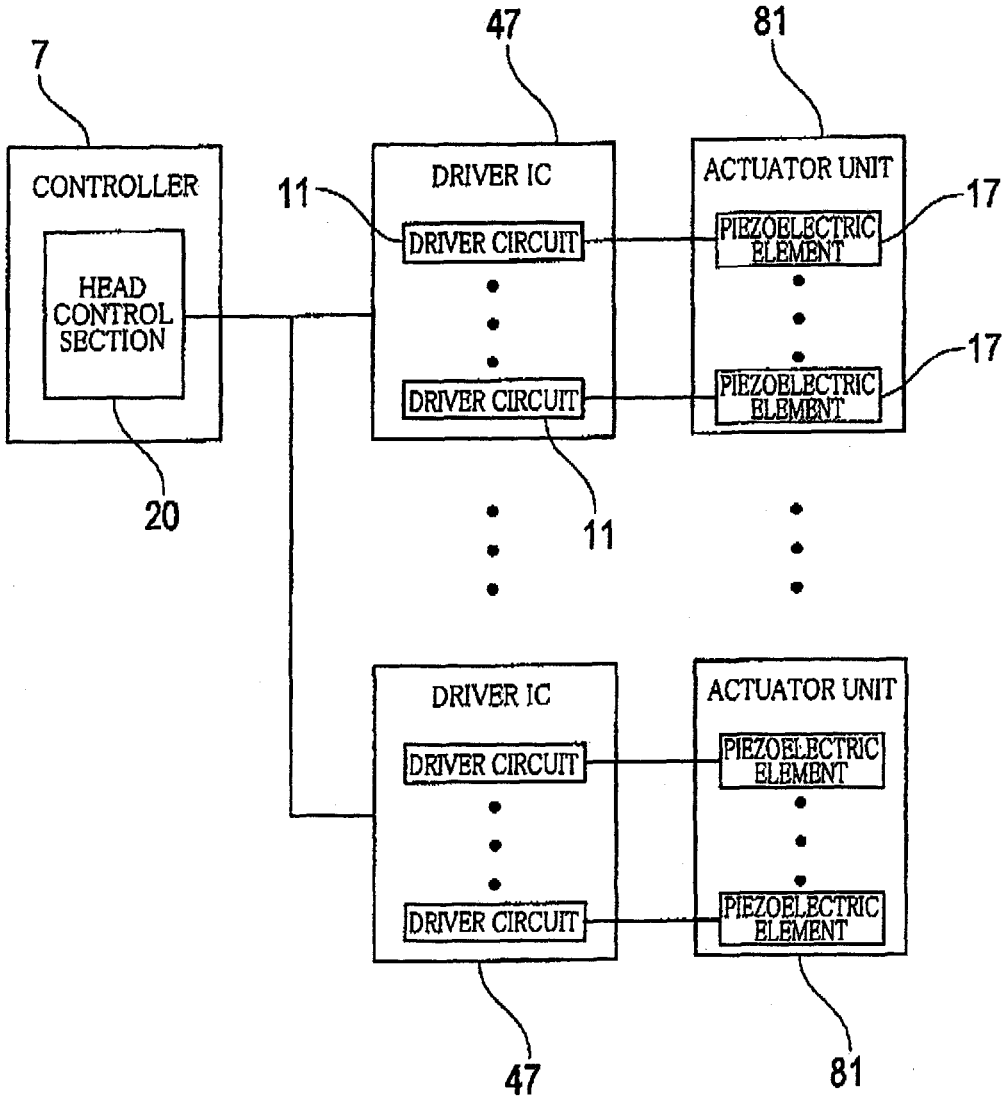
FIG. 5 is a block diagram showing a general configuration of a drive circuit of an ink ejection head.

There will be next explained a drive circuit of the ink ejection head 31 in the first embodiment, i.e., a drive circuit for each piezoelectric element 17 of the actuator unit 81. As shown in FIG. 5, the ink ejection head 31 includes the plurality of the actuator units 81, and each actuator unit 81 includes the multiplicity of the piezoelectric elements 17 (k piezoelectric elements 17 in this explanation). Each piezoelectric element 17 is driven by a corresponding one of driver ICs 47. The k driver circuits 11 are mounted on each of the driver ICs 47 in correspondence with the respective k piezoelectric elements 17. The k driver circuits 11 generate drive voltages to be applied to the respective piezoelectric elements 17.

Figure 6:
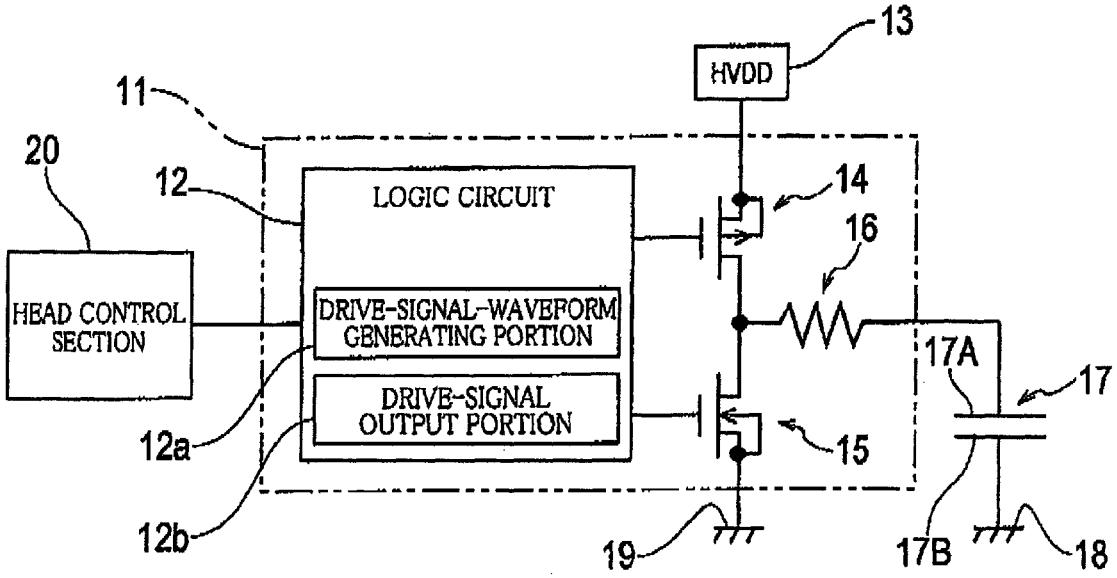
FIG. 6 is a circuit diagram of a drive structure of a piezoelectric element in a first embodiment of the present invention.

FIG. 6 is a circuit diagram of a general structure of the driver circuit 11 for driving the piezoelectric element 17. FIG. 6 shows the driver circuit 11 for one piezoelectric element 17 for easier understanding purpose. The driver circuit 11 includes a logic circuit 12 and two field effect transistors (FETs) 14, 15. Two output lines are connected to the logic circuit 12. One of the output lines is connected to a gate terminal of the ON-side FET 14, and the other of the output lines is connected to a gate terminal of the OFF-side FET 15. A source terminal of the ON-side FET 14 is connected to a HVDD terminal 13. A voltage of a reference voltage level (=HV1 [V]) is supplied from a power source (constant voltage source) to the HVDD terminal 13. A source terminal of the OFF-side FET 15 is connected to a ground 19. A drain terminal of the ON-side FET 14 and a drain terminal of the OFF-side FET 15 are connected to each other with a signal line. This signal line is connected to one of electrodes, i.e., an electrode 17A (corresponding to the individual electrode 43) of the piezoelectric element 17 via a resistor 16. The other of the electrodes, i.e., an electrode 17B (corresponding to the vibration plate 41 as the common electrode) of the piezoelectric element 17 is grounded to a ground 18.

The logic circuit 12 includes: a drive-signal-waveform generating portion 12*a* configured to generate a drive waveform based on recording data supplied from a head control section 20; and a drive-signal output portion 12*b* configured to output drive signal(s) (the drive pulse(s)) based on the generated drive waveform. That is, the logic circuit 12 functions as a charge control section (as one example of a charge controller) configured to generate a drive signal for charging an interelectrode voltage of the electrode 17A of the piezoelectric element 17 to the reference voltage level and transmit the generated drive signal selectively to the ON-side FET 14 (as one example of a switch element) and the OFF-side FET 15 (as another example of the switch element) and also functions as a discharge control section (as one example of a discharge controller) configured to generate a drive signal for discharging the interelectrode voltage of the electrode 17A of the piezoelectric element 17 to the ground level and transmit the generated drive signal selectively to the ON-side FET 14 and the OFF-side FET 15. It is noted that the head control section 20 is one of functional sections of the controller 7, and the head control section 20 is for controlling the ejecting operation of the ink ejection head 31 based on the recording data.

The drive waveform generated by the drive-signal-waveform generating portion 12*a* is a waveform in which a voltage level changes between two values ("Hi" and "Lo"), that is, this drive waveform is a pulse waveform. In the present embodiment, the drive-signal output portion 12*b* of the logic circuit 12 is configured to execute a logical operation based on the generated drive waveform and output Hi or Lo drive signals (each as one example of a first drive signal and a second drive signal) respectively to the ON-side FET 14 and the OFF-side FET 15. When the first drive signal of the Hi (high) voltage level is inputted to the gate terminal of the ON-side FET 14, the ON-side FET 14 becomes an ON state (i.e., a state in which the electrode 17A and the HVDD terminal 13 are connected to each other). When the first drive signal of the Lo (low) voltage level is inputted to the gate terminal of the ON-side FET 14, the ON-side FET 14 becomes an OFF state (i.e., a state in which the electrode 17A and the HVDD terminal 13 are not connected (disconnected) from each other). It is noted that, since the ON-side FET 14 is a P-type MOSFET, the ON-side FET 14 becomes the ON state by gate input of the signal of the Lo voltage level (not the Hi voltage level) in reality, but the explanation is made by assuming that the ON-side FET 14 becomes the ON state by gate input of the signal of the Hi voltage level for easier understanding purpose. When the second drive signal of the Hi voltage level is inputted to the gate terminal of the OFF-side FET 15, the OFF-side FET 15 becomes an ON state (i.e., a state in which the electrode 17A and the ground 19 are connected to each other). When the second drive signal of the Lo voltage level is inputted to the gate terminal of the OFF-side FET 15, the OFF-side FET 15 becomes an OFF state (i.e., a state in which the electrode 17A and the ground 19 are not connected (disconnected) from each other). Here, when the ON-side FET 14 is in the ON state, and the OFF-side FET 15 is in the OFF state, an output voltage level of the driver circuit 11 is the reference voltage level. Thus, the drive voltage of the reference voltage level is applied to the electrode 17A of the piezoelectric element 17. On the other hand, when the ON-side FET 14 is in the OFF state, and the OFF-side FET 15 is in the ON state, the output voltage level of the driver circuit 11 is the ground level (=0 [V]). That is, the electrode 17A of the piezoelectric element 17 is grounded so as to take a state in which the drive voltage is not applied to the electrode 17A of the piezoelectric element 17. In the manner described above, each piezoelectric element 17 is driven by the corresponding driver circuit 11 independently.

Figure 7:
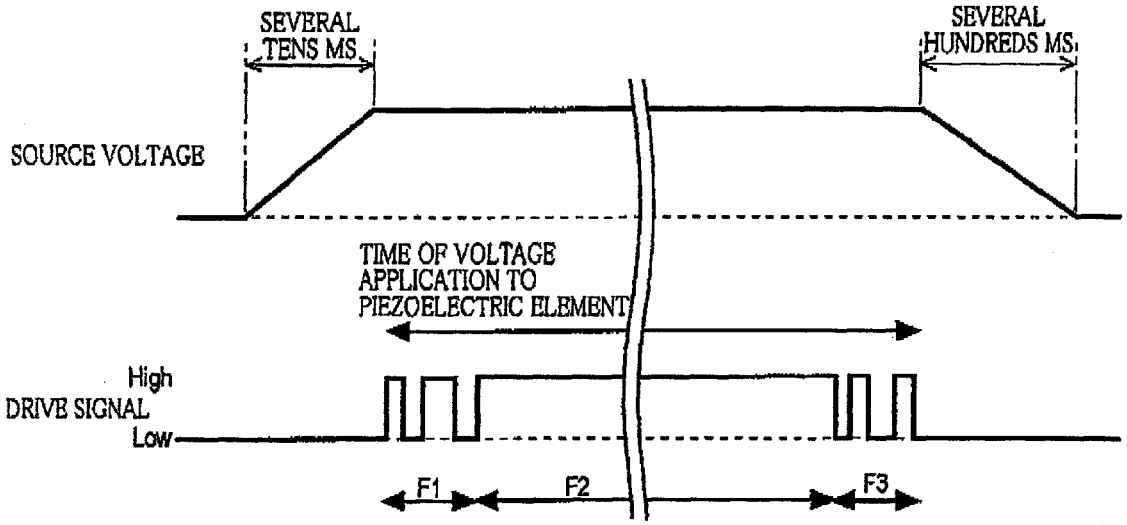
FIG. 7 is a timing chart showing a change of a source voltage and drive signals in a driver circuit.

FIG. 7 shows a timing chart of a change of the source voltage and the drive signals in the driver circuit. A time change of the drive signals is represented as a drive signal waveform in FIG. 7. In this drive signal waveform, a high (Hi) level and a low (Lo) level corresponding to one pulse of the drive signals repeatedly appear in a period in which the source voltage is stabilized at the reference voltage level. When the drive signal is in the Hi (voltage) level, the driver circuit 11 is in a state in which the voltage of the reference voltage level is applied to the electrode 17A of the piezoelectric element 17 (hereinafter may be called an ON state). On the other hand, when the drive signal is in the Lo (voltage) level, the driver circuit 11 is in a state in which the electrode 17A of the piezoelectric element 17 is grounded (hereinafter may be called an OFF state). The drive signal waveform includes a charging waveform F1, a recording wait waveform F2, and a discharging waveform F3. The voltage is applied to the piezoelectric element 17 substantially in a period in which these waveforms F1, F2, F3 appear.

The recording wait waveform F2 represents a period in which the ejecting operation can be performed using the piezoelectric element 17. When the drive signals (the Lo and Hi pulse waveform) for the ink ejection are applied in this period, the ink droplet can be ejected from the ejection opening 85. As to the drive signals for the ink ejection, when two pulse signals are outputted successively, for example, the two ejecting operations are performed successively in the piezoelectric element 17, whereby two ink droplets are ejected from the ejection opening 85 successively. As a result, the two ink droplets are landed on the recording sheet 4, and one dot is formed.

The charging waveform F1 is a drive signal waveform in a transition period in which the interelectrode voltage of the piezoelectric element 17 is changed from the ground level to the reference voltage level in order to establish a state in which the ink ejection head 31 can eject the ink. The driver circuit 11 repeatedly establishes the ON state intermittently based on the charging waveform F1, whereby the voltage applied to the electrode 17A of the piezoelectric element 17 intermittently. Specifically, a change between the ON state of the ON-side FET 14 (the state in which the electrode 17A and the HVDD terminal 13 are connected to each other) and the OFF state of the ON-side FET 14 (the state in which the electrode 17A and the HVDD terminal 13 are not connected (disconnected) from each other) is repeated in the state in which the OFF-side FET 15 is in the OFF state (the state in which the electrode 17A and the ground 19 are not connected (disconnected) from each other). That is, the interelectrode voltage of the piezoelectric element 17 is increased from the ground level to the reference voltage level by a plurality of voltage applications. This enables stepwise charging of the piezoelectric element 17, making it possible to prevent misejection due to sudden change of the interelectrode voltage of the piezoelectric element 17.

Further, the discharging waveform F3 is a drive signal waveform in a transition period in which the interelectrode voltage of the piezoelectric element 17 is changed from the reference voltage level to the ground level after the ink ejection head 31 finishes a series of the ejecting operations (i.e., an ejecting operation on one page of the recording sheet 4, for example). That is, the discharging waveform F3 is a drive signal waveform of a discharge period. The change (transition) of the interelectrode voltage of the piezoelectric element 17 from the reference voltage level to the ground level is for a preparation to turning off the printer 1 or for removing electricity from the piezoelectric element 17 in a period in which the ink is not ejected in order to reduce deterioration of the piezoelectric element 17, for example. In the discharging waveform F3, the driver circuit 11 repeatedly establishes the OFF state intermittently, whereby the electrode 17A of the piezoelectric element 17 is grounded intermittently. Specifically, a change between the ON state of the OFF-side FET 15 (the state in which the electrode 17A and the ground 19 are connected to each other) and the OFF state of the OFF-side FET 15 (the state in which the electrode 17A and the ground 19 are not connected (disconnected) from each other) is repeated in the state in which the ON-side FET 14 is in the OFF state (the state in which the electrode 17A and the HVDD terminal 13 are not connected (disconnected) from each other). That is, the interelectrode voltage of the piezoelectric element 17 is reduced from the reference voltage level to the ground level by a plurality of the groundings. This enables stepwise discharging of an electrostatic capacity of the piezoelectric element 17, making it possible to prevent the misejection due to the sudden change of the interelectrode voltage of the piezoelectric element 17.

Models of the charging waveform F1 and the discharging waveform F3 are stored in a memory integrated in the driver circuit 11 in advance, and the drive-signal-waveform generating portion 12*a* generates the drive signal waveform, by using these models. However, since an amount (degree) of the change of the interelectrode voltage of the piezoelectric element 17 which causes the misejection changes depending upon various factors such as an ambient temperature and a color of the ink upon the electric charge and discharge, the charging waveform F1 and the discharging waveform F3 may be set depending upon an ejection condition or the like. In this case, for example, a model or a formula for obtaining the charging waveform F1 and the discharging waveform F3 are stored in the memory integrated in the driver circuit 11 in advance, and the drive-signal-waveform generating portion 12*a* obtains the charging waveform F1 and the discharging waveform F3 based on information such as the ejection condition and initial charge of the piezoelectric element 17 given to the driver circuit 11 to generate the drive signal waveform by using these.

Figure 17:
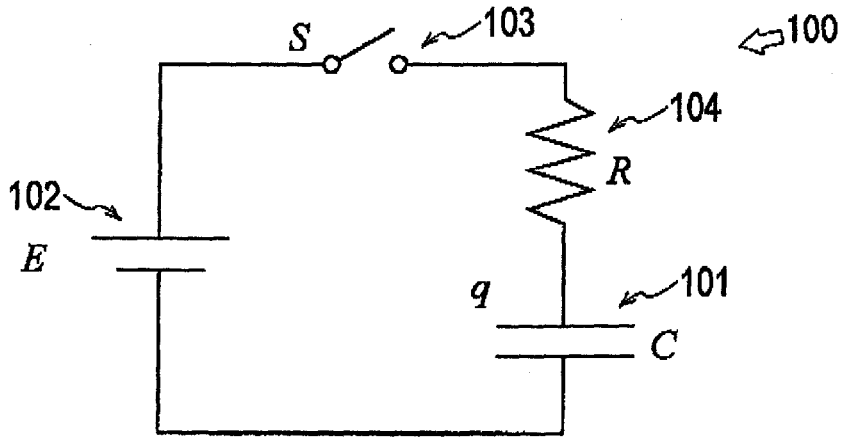
FIG. 17 is a diagram of a common electric circuit including a condenser.

Here, the charging waveform F1 and the discharging waveform F3 will be explained in more detail. Initially, there will be explained electric charge accumulated in a condenser in a common electric circuit having the condenser for reference. FIG. 17 shows a common electric circuit 100 including: a condenser 101 having electrostatic capacity C; a power source 102 of voltage E; an on/off switch 103; a resistor 104 having a resistance value R which are connected to one another in series. A voltage Vt between terminals of the condenser 101 after t seconds elapsed from change of the switch 103 from its OFF state to its ON state in the electric circuit 100 is represented by the following formula (1).

$$Vt = E\left(1 - e^{-\frac{t}{CR}}\right) \quad \text{[Formula (1)]}$$

If this formula (1) is applied to the circuit comprised of the driver circuit 11 and the piezoelectric element 17 shown in FIG. 6, the voltage between the electrode 17A and the electrode 17B of the piezoelectric element 17 is represented as "Vt", the electrostatic capacity of the piezoelectric element 17 as "C", the voltage of the HVDD terminal 13 as "E", and the resistance value of the resistor 16 as "R".

In the charging waveform F1 and the discharging waveform F3, a length of time of the high (Hi) level of the drive signal and a length of time of the low (Lo) level of the drive signal (that is, a pulse width and a pulse period of the drive signals) have a relationship described below. It is noted that the pulse width is a length of time between a rise of a pulse and a fall thereof, and a pulse period is a length of time between a rise (fall) of one pulse and a rise (fall) of a next pulse.

Figures 8A, 8B:
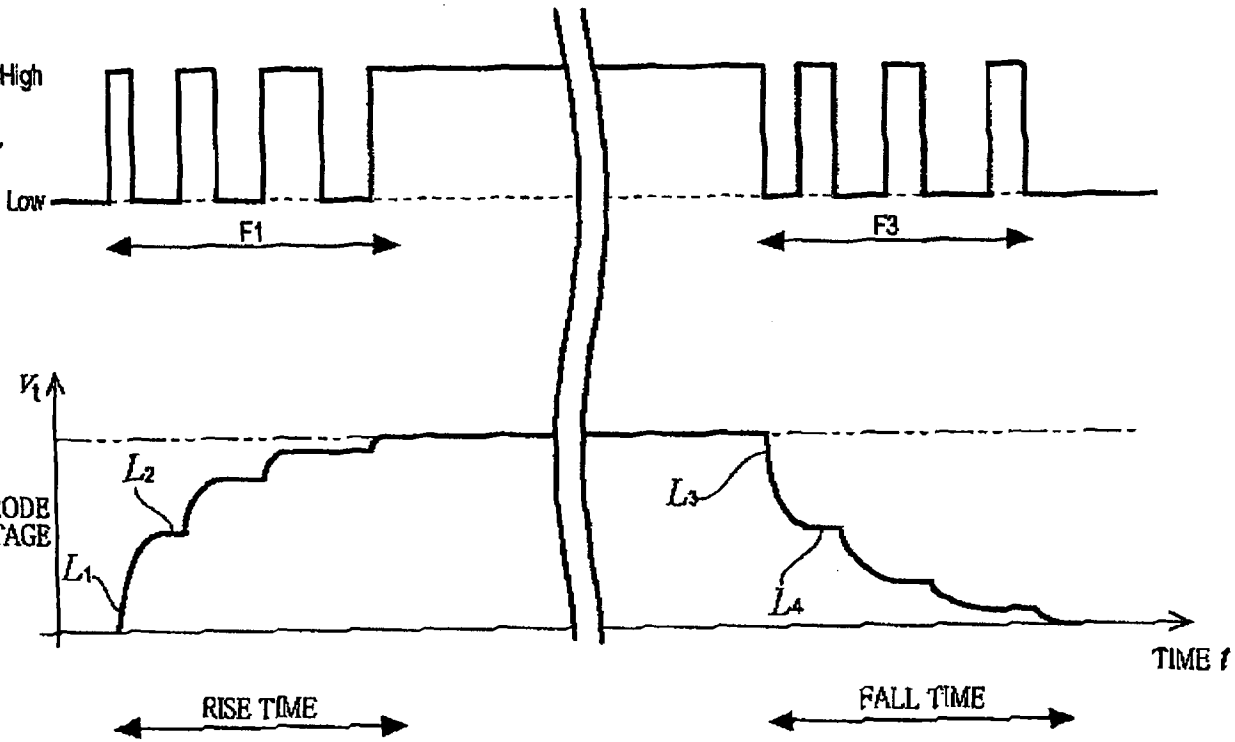
FIG. 8A is a timing chart showing the drive signals of the driver circuit upon an electric charge and discharge operation of the piezoelectric element.
FIG. 8B is a view corresponding to FIG. 8A and showing a time change of an interelectrode voltage of the piezoelectric element upon the electric charge and discharge operation of the piezoelectric element.

FIG. 8A is a timing chart showing the drive signals of the driver circuit 11 upon the electric charge and discharge operation of the piezoelectric element 17. A drive signal waveform shown in FIG. 8A shows a time change of the drive signals outputted from the drive-signal output portion 12*b* of the logic circuit 12 to change the interelectrode voltage of the piezoelectric element 17. Each of these drive signals is a pulse signal whose voltage level changeable between "Lo" and "Hi". The Hi (high level) represents the ON state of the driver circuit 11, and the Lo (low level) represents the OFF state of the driver circuit 11. The operations of the ON-side FET 14 and the OFF-side FET 15 upon the electric charge and discharge (i.e., F1 and F3) are as described above. It is noted that an electric potential of the electrode 17B as the other electrode of the piezoelectric element 17 is kept at the ground level upon the electric charge and discharge operation of the piezoelectric element 17.

FIG. 8B shows a time change of the interelectrode voltage Vt of the piezoelectric element 17 upon the electric charge and discharge operation of the piezoelectric element 17. A time axis (i.e., a horizontal axis) in FIGS. 8A and 8B corresponds to a right and left direction of a sheet face of FIGS. 8A and 8B. As shown in FIG. 8B, in a curve representing the time change of the interelectrode voltage Vt of the piezoelectric element 17 which corresponds to the charging waveform F1 (hereinafter may be referred to as "charging interelectrode voltage curve"), rise portions $L_1$ each corresponding to the Hi level of the drive signal and nonrise portions $L_2$ each corresponding to the Lo level of the drive signal alternately appear. An inclination of the rise portion $L_1$ is steep just after the level of the drive signal is changed from the Lo level to the Hi level, but decreases with a lapse of time. In the nonrise portions $L_2$, the interelectrode voltage Vt is generally constant or slightly increases or decreases. The rise portion $L_1$ and the nonrise portion $L_2$ following this rise portion $L_1$ are continuous to each other. Rise cycles each constituted by the rise portion $L_1$ and the nonrise portion $L_2$ in correspondence with one pulse constituted by the Hi level and the Lo level of the drive signals appear in the charging interelectrode voltage curve. The number of the rise cycles appearing in the charging interelectrode voltage curve corresponds to the number of pulses of the drive signals in the charging waveform F1.

A degree of the steepness of the inclination of the rise portion $L_1$ of the charging interelectrode voltage curve is determined by "(t/CR)" in the formula (1). If the voltage E of the HVDD terminal 13 is constant in the electric charge of the piezoelectric element 17, the inclination of the rise portion $L_1$ decreases with a lapse of time t. This is because the inclination of the rise portion $L_1$ corresponds to a time change of "Vt". If the inclination of the rise portion $L_1$ decreases with subsequent rise cycles, an increase rate of the interelectrode voltage per a specific charging time decreases, resulting in an increase in a length of time required for the drive voltage to rise (a rise time). Thus, the later the time t, the longer a period of the Hi level of the drive signal in the rise portion $L_1$ is set such that an amount of an increase in the interelectrode voltage in each rise portion $L_1$ is made closer to an amount of an increase in the interelectrode voltage in a first rise portion $L_1$ appearing after a start of the electric charge (i.e., the first rise portion $L_1$ among the rise portions $L_1$). Where the period of the Hi level of the drive signal in the rise portion $L_1$ is thus set, if the misejection has not occurred in the first rise portion $L_1$ appearing after the start of the electric charge, the misejection never occurs in the subsequent rise portions in each of which the amount of the increase in the interelectrode voltage is equal to or less than that in the first rise portion $L_1$ appearing after the start of the electric charge. Thus, it is possible to reduce a time required for the electric charge of the piezoelectric element 17 while preventing the misejection. That is, it is possible to reduce the rise time of the drive voltage of the piezoelectric element 17, i.e., the time required for the electric charge of the piezoelectric element 17 when compared to a case where the width and the period of the pulse of the drive signals are constant as in the conventional technique. In addition, it is generally known that a degree of the deterioration of the piezoelectric element is proportional to a length of time in which the voltage is applied to the piezoelectric element, but in this embodiment, the length of time in which the voltage is applied to the piezoelectric element upon the electric charge can be shortened. Thus, it is possible to suppress the deterioration of the piezoelectric element, thereby increasing a useful life of the piezoelectric element.

In order to obtain the charging interelectrode voltage curve having the above-described feature, the charging waveform F1 is set such that a length of time of the Lo level of the drive signal is constant, and a length of time of the Hi level of the drive signal increases, for example. The length of time of the Hi level of the drive signal is a pulse width of the drive signal and corresponds to the time t in the formula (1). This charging waveform F1 is a pulse waveform in which, as shown in FIG. 8A, the pulse width is changed such that the length of time of the Lo level is constant, and the length of time of the Hi level gradually increases, for example. It is noted that the charging interelectrode voltage curve having the above-mentioned feature may be obtained by performing a pulse width modulation (PWM) in which a ratio between the length of time of the Hi level and the length of time of the Lo level is set such that the length of time of the Hi level gradually increases in a state in which a period of each pair of the Hi level and the Lo level of the drive signals is constant.

It is noted that, in each of the charging waveform F1 and the discharging waveform F3, the length of time of the Hi level and the length of time of the Lo level in one pulse are set as a rule such that an amount of a change in the interelectrode voltage Vt of the piezoelectric element 17 is an amount not causing the voltage to exceed at least the source voltage level in order to prevent the misejection from the corresponding ejection opening 85. Further, in each of the charging waveform F1 and the discharging waveform F3, the length of time of the Hi level and the length of time of the Lo level in one pulse are set in each of the subsequent pulses such that the amount of the increase (or decrease) in the interelectrode voltage therein is made closer to that in the first rise portion (or fall portion). However, strictly speaking, since the misejection is more likely to be caused as a driving (deformation) acceleration of the piezoelectric element 17 is large, the length of time of the Hi level and the length of time of the Lo level in one pulse are preferably set in each of the subsequent pulses such that an acceleration (average acceleration) of interelectrode voltage therein is made closer to that in the first rise portion (or fall portion). In this case, the amount of the increase (or decrease) in the interelectrode voltage in each subsequent pulse may be larger than that in the first rise portion (or fall portion). It is noted that, considering an effect on a pressure wave in the individual ink channel 90, the length of time of the Lo level of the drive signal in each of the charging waveform F1 and the discharging waveform F3 is set at a time that is not an integral multiple of a period specific to a vibration of a meniscus of the ink in the ink ejection head 31.

When the driver circuit 11 is operated based on the charging waveform F1 as described above, the electrode 17A is charged to the reference voltage level while repeating connections (connected states) and disconnections (disconnected states) between the electrode 17A as one of the two electrodes of the piezoelectric element 17 and the HVDD terminal 13 (the power source) in a state in which the voltage of the power source is kept at the reference voltage level. In this operation, the connections and the disconnections between the electrode 17A and the HVDD terminal 13 are repeated while gradually increasing a time of the connection therebetween (connection time) and keeping a time of the disconnection therebetween (disconnection time) constant. In other words, in at least one of second and subsequent cycles each constituted by the connection time between the electrode 17A and the power source and the disconnection time therebetween continued from the connection time after the start of the electric charge, the connections and the disconnections between the electrode 17A and the HVDD terminal 13 are repeated such that a ratio of the connection time to the disconnection time is greater than that in a first cycle appearing after the start of the electric charge. As a result of these intermittent connections between the HVDD terminal 13 and the electrode 17A, as shown in FIG. 8B for example, the rise cycles each constituted by a corresponding one of the rise portions $L_1$ and a corresponding one of the nonrise portion $L_2$ which is continued therefrom appear in the charging interelectrode voltage curve. Here, in at least one of the second and subsequent rise cycles after the start of the electric charge, a time ratio of the rise portion $L_1$ to the nonrise portion $L_2$ is greater than that in the first rise cycle after the start of the electric charge. In other words, in a single charge control executed by the logic circuit 12 for charging the electrode 17A from the ground level to the reference voltage level, the time ratio of the rise portion $L_1$ to the nonrise portion $L_2$ continued therefrom in each of at least one of the second and subsequent rise cycles after the start of the charge control is greater than the time ratio in the first rise cycle after the start of the charge control (i.e., the time ratio of the first rise portion to the nonrise portion continued therefrom after the start of the charge control).

There will be next explained a relationship between the length of time of the Hi level and the length of time of the Lo level of the drive signals in the discharging waveform F3 in more detail. As described above, in the discharging waveform F3, the length of time of the Hi level of the drive signal represents the state in which the OFF-side FET 15 is in the OFF state (i.e., the state in which the electrode 17A and the ground 19 are not connected (disconnected) from each other) while the ON-side FET 14 is in the OFF state (i.e., the state in which the electrode 17A and the HVDD terminal 13 are not connected (disconnected) from each other). That is, when the drive signal is the Hi level in the discharging waveform F3, the electrode 17A as one of the electrodes of the piezoelectric element 17 and the ground 19 are not connected to each other. In the discharging waveform F3, the length of time of the Lo level of the drive signal is a time of the OFF state of the driver circuit and represents the state in which the ON-side FET 14 is in the OFF state (i.e., the state in which the electrode 17A and the HVDD terminal 13 are not connected (disconnected) from each other) while the OFF-side FET 15 is in the ON state or the discharging state (i.e., the state in which the electrode 17A and the ground 19 are connected to each other). That is, when the drive signal is the Lo level in the discharging waveform F3, the electrode 17A as one of the electrodes of the piezoelectric element 17 and the ground 19 are connected to each other.

The discharging waveform F3 has a feature similar to that of the charging waveform F1. For example, the discharging waveform F3 is set such that the length of time of the Lo level of the drive signal is constant, and the length of time of the Hi level of the drive signal decreases, for example. This discharging waveform F3 is a pulse waveform in which, as shown in FIG. 8A, the pulse width is changed such that the length of time of the Hi level is constant, and the length of time of the Lo level gradually increases, for example. It is noted that a discharging interelectrode voltage curve having the above-mentioned feature may be obtained by performing a pulse width modulation (PWM) in which the ratio between the length of time of the Hi level and the length of time of the Lo level is set such that the length of time of the Lo level gradually increases in the state in which the period of each pair of the Hi level and the Lo level of the drive signals is constant.

When the driver circuit 11 is operated based on the discharging waveform F3 as described above, the electrode 17A as one of the electrodes of the piezoelectric element 17 charged to the reference voltage level is discharged to the ground level while repeating the connections (connected states) and the disconnections (disconnected states) between the electrode 17A and the ground 19. In this operation, the connections and the disconnections between the electrode 17A and the ground 19 are repeated while gradually increasing the connection time therebetween and keeping the disconnection time therebetween constant. In other words, in at least one of second and subsequent cycles each constituted by the connection time between the electrode 17A and the ground 19 and the disconnection time therebetween continued from the connection time after the start of the electric discharge, the connections and the disconnections between the electrode 17A and the ground 19 are repeated such that a ratio of the connection time to the disconnection time is greater than that in a first cycle appearing after the start of the electric discharge. As a result of these intermittent connections between the electrode 17A and the ground 19, as shown in FIG. 8B for example, the fall cycles each corresponding to one pulse and each constituted by a corresponding one of the fall portions $L_3$ and a corresponding one of the nonfall portions $L_4$ which is continued therefrom appear in the curve representing the time change of the interelectrode voltage Vt of the piezoelectric element 17 which corresponds to the discharging waveform F3 (hereinafter may be referred to as "discharging interelectrode voltage curve"). The number of the fall cycles in the discharging interelectrode voltage curve corresponds to the number of the pulses in the discharging waveform F3. In at least one of the second and subsequent fall cycles after the start of the electric discharge, a time ratio of the fall portion $L_3$ to the nonfall portion $L_4$ is greater than that in the first fall cycle after the start of the electric discharge. In other words, in a single discharge control executed by the logic circuit 12 for discharging the electrode 17A from the reference voltage level to the ground level, the time ratio of the fall portion $L_3$ to the nonfall portion $L_4$ continued therefrom in each of at least one of the second and subsequent fall cycles after the start of the discharge control is greater than the time ratio in the first fall cycle after the start of the discharge control (i.e., the time ratio of the first fall portion to the nonfall portion continued therefrom after the start of the discharge control).

In the drive circuit for the piezoelectric element 17 and a method for driving the piezoelectric element 17 described above, the interelectrode voltage Vt of the piezoelectric element 17 is increased stepwise in the transition period in which the interelectrode voltage of the piezoelectric element 17 rises from the ground level to the reference voltage level. Thus, it is possible to prevent the sudden change of the interelectrode voltage Vt of the piezoelectric element 17. Further, the interelectrode voltage Vt of the piezoelectric element 17 is reduced stepwise in the transition period in which the interelectrode voltage of the piezoelectric element 17 falls from the reference voltage level to the ground level. Thus, it is possible to prevent the sudden change of the interelectrode voltage Vt of the piezoelectric element 17. This makes it possible to prevent the misejection from the ink ejection head 31.

Further, in the drive circuit for the piezoelectric element 17 and the method for driving the piezoelectric element 17 described above, a degree of the change between (i) an amount of the increase in the interelectrode voltage of the rise portion $L_1$ appearing first in the curve representing the time change of the interelectrode voltage Vt of the piezoelectric element 17 (i.e., the charging interelectrode voltage curve) and (ii) an amount of the increase in the interelectrode voltage of the rise portion $L_1$ appearing second or subsequent time in the charging interelectrode voltage curve gradually decreases with a lapse of time in the transition period in which the interelectrode voltage of the piezoelectric element 17 rises from the ground level to the reference voltage level. Thus, it is possible to reduce the time required for the electric charge of the piezoelectric element 17 when compared to a case where an amount of the increase in the interelectrode voltage of the rise portion $L_1$ gradually decreases (for example, in the conventional technique). Further, a degree of the change between (i) an amount of the decrease in the interelectrode voltage of the fall portion $L_3$ appearing first in the curve representing the time change of the interelectrode voltage Vt of the piezoelectric element 17 (i.e., the discharging interelectrode voltage curve) and (ii) an amount of the decrease in the interelectrode voltage of the fall portion $L_3$ appearing second or subsequent time in the discharging interelectrode voltage curve gradually decreases with a lapse of time in the transition period in which the interelectrode voltage of the piezoelectric element 17 falls from the reference voltage level to the ground level. Thus, it is possible to reduce the time required for the electric discharge of the piezoelectric element 17 when compared to a case where an amount of the decrease in the interelectrode voltage of the fall portion $L_3$ gradually decreases. Accordingly, since the time required for the electric charge and discharge of the piezoelectric element 17 can be reduced, it is possible to reduce a length of time in which the voltage is applied to the piezoelectric element 17, resulting in a longer useful life of the piezoelectric element 17.

First Modification

In the charging waveform F1 and the discharging waveform F3 shown in FIG. 8A, a duty ratio for charging or discharging the piezoelectric element 17 is changed in the pulse wave(s). However, the charging waveform F1 and the discharging waveform F3 can also be obtained by making a pulse width constant and changing a period of the pulse wave. There will be explained a first modification of the above-described embodiment where a period of a pulse wave of the drive signal waveform outputted from the logic circuit 12 is changed in the charging waveform F1 and the discharging waveform F3.

Figures 9A, 9B:
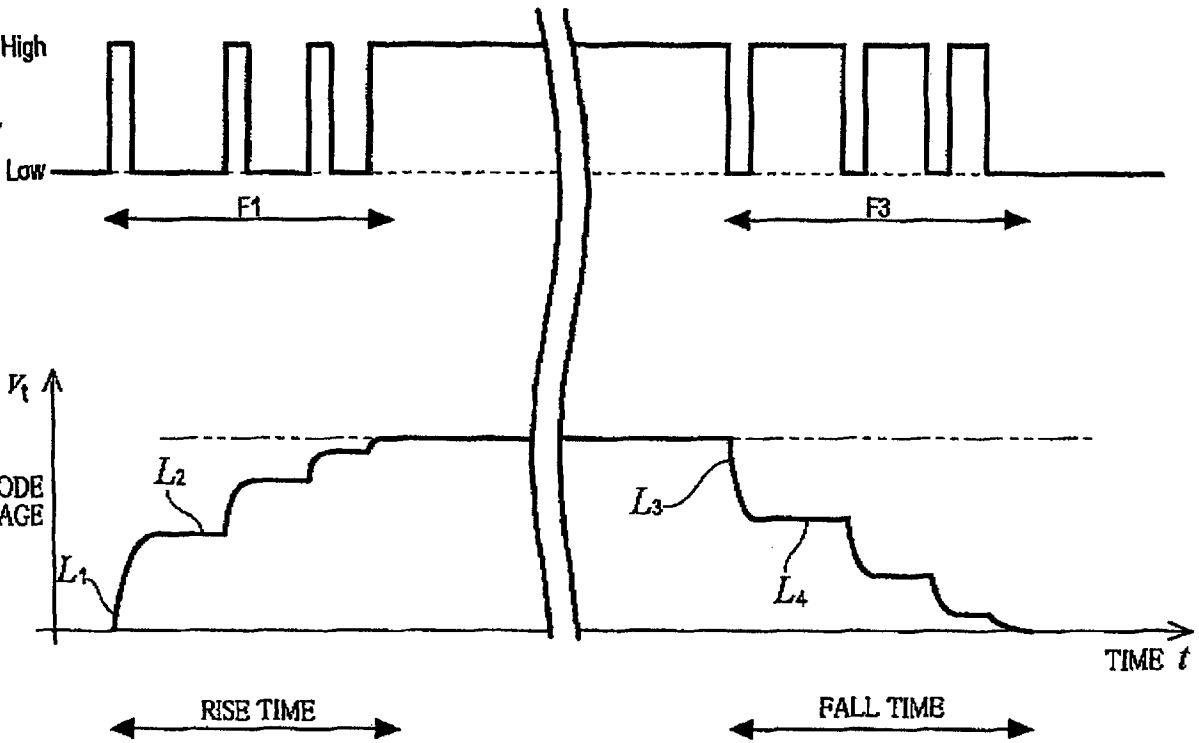
FIG. 9A is a timing chart showing the drive signals of the driver circuit upon the electric charge and discharge operation of the piezoelectric element in a first modification.
FIG. 9B is a view corresponding to FIG. 9A and showing the time change of the interelectrode voltage of the piezoelectric element upon the electric charge and discharge operation of the piezoelectric element in the first modification.

For example, as shown in FIG. 9A, in the charging waveform F1, the length of time of the Hi level of the drive signal is constant, and the length of time of the Lo level of the drive signal decreases in correspondence with a decrease in a difference between a present interelectrode voltage Vt of the piezoelectric element 17 and an interelectrode voltage Vt thereof after the electric charge. This charging waveform F1 is a waveform in which a pulse width (corresponding to the length of time of the Hi level of the drive signal) is constant, and a period (corresponding to a total time of the Hi level and the Lo level of the drive signals) changes so as to gradually decrease. This waveform can be obtained by modulating a periodic pulse wave by a pulse frequency modulation (PFM).

When the driver circuit 11 is operated based on the charging waveform F1 as described above, the electrode 17A is charged to the reference voltage level while repeating the connections (connected states) and the disconnections (disconnected states) between the electrode 17A as one of the two electrodes of the piezoelectric element 17 and the HVDD terminal 13 (the power source) in the state in which the voltage of the power source is kept at the reference voltage level. In this operation, the connections and the disconnections between the electrode 17A and the HVDD terminal 13 are repeated while gradually reducing the disconnection time therebetween and keeping the connection time therebetween constant. As a result, in at least one of second and subsequent cycles each constituted by the connection time between the electrode 17A and the power source (i.e., the ON state of the driver circuit 11) and the disconnection time therebetween (i.e., the OFF state of the driver circuit 11) continued from the connection time after the start of the electric charge, the connections and the disconnections between the electrode 17A and the HVDD terminal 13 are repeated such that the ratio of the connection time to the disconnection time is greater than that in the first cycle appearing after the start of the electric charge. As a result of these intermittent connections between the HVDD terminal 13 and the electrode 17A, as shown in FIG. 9B for example, the rise cycles each constituted by a corresponding one of the rise portions $L_1$ and a corresponding one of the nonrise portion $L_2$ which is continued therefrom repeatedly appear in this charging interelectrode voltage curve. Here, in at least one of the second and subsequent rise cycles after the start of the electric charge, the time ratio of the rise portion $L_1$ to the nonrise portion $L_2$ is greater than that in the first cycle after the start of the electric charge.

The discharging waveform F3 has a feature similar to that of the charging waveform F1. That is, as shown in FIG. 9A, in the discharging waveform F3, the length of time of the Lo level of the drive signal is constant, and the length of time of the Hi level of the drive signal decreases in correspondence with a decrease in a difference between a present interelectrode voltage Vt of the piezoelectric element 17 and an interelectrode voltage Vt thereof after the electric discharge. This discharging waveform F3 is a waveform in which a pulse width (corresponding to the length of time of the Lo level of the drive signal) is constant, and a period (corresponding to a total time of the Hi level and the Lo level of the drive signals) changes so as to gradually decrease.

When the driver circuit 11 is operated based on the discharging waveform F3 as described above, the electrode 17A as one of the electrodes of the piezoelectric element 17 charged to the reference voltage level is discharged to the ground level while repeating the connections (connected states) and the disconnections (disconnected states) between the electrode 17A and the ground 19. In this operation, the connections and the disconnections between the electrode 17A and the ground 19 are repeated while gradually reducing the disconnection time therebetween and keeping the connection time constant. As a result, in at least one of second and subsequent cycles each constituted by the connection time between the electrode 17A and the ground 19 and the disconnection time therebetween continued from the connection time after the start of the electric discharge, the connections and the disconnections between the electrode 17A and the ground 19 are repeated such that the ratio of the connection time to the disconnection time is greater than that in the first cycle appearing after the start of the electric discharge. As a result of these intermittent connections between the electrode 17A and the ground 19, as shown in FIG. 9B for example, cycles each constituted by a corresponding one of the fall portions $L_3$ and a corresponding one of the nonfall portions $L_4$ which is continued therefrom appear in a curve representing a time change of the interelectrode voltage of the piezoelectric element 17. Here, the time ratio of the fall portion $L_3$ to the nonfall portion $L_4$ in at least one of the second and subsequent cycles each constituted by a corresponding one of the fall portions $L_3$ and a corresponding one of the nonfall portions $L_4$ after the start of the electric discharge is greater than that in the first cycle after the start of the electric discharge.

Second Modification

As described above, the logic circuit 12 of the driver circuit 11 in the first embodiment outputs the Hi level or the Lo level drive signals to the ON-side FET 14 and the OFF-side FET 15. However, the logic circuit 12 may be configured such that signals are outputted as a pair from the logic circuit 12 respectively to the ON-side FET 14 and the OFF-side FET 15, that is such that, the Hi level signals are outputted to the ON-side FET 14, and the Lo level signals are outputted to the OFF-side FET 15, and vice versa. There will be explained a second modification of the above-described embodiment where the logic circuit 12 of the driver circuit 11 outputs the Hi level signal to one of the ON-side FET 14 and the OFF-side FET 15 and the Lo level signal to the other.

In this second modification, the ON-side FET 14 and the OFF-side FET 15 of the driver circuit 11 are controlled by the logic circuit 12 such that only one of the HVDD terminal 13 and the ground 19 is connected to the electrode 17A of the piezoelectric element 17 at a time. This configuration of the logic circuit 12 can simplify the circuit structure of the logic circuit 12. It is noted that, when the ON-side FET 14 and the OFF-side FET 15 are switched, the logic circuit 12 delays the switching of the ON-side FET 14 or the OFF-side FET 15 momentarily so as not to establish a short circuit from the HVDD terminal 13 to the ground 19.

Figures 10A, 10B:
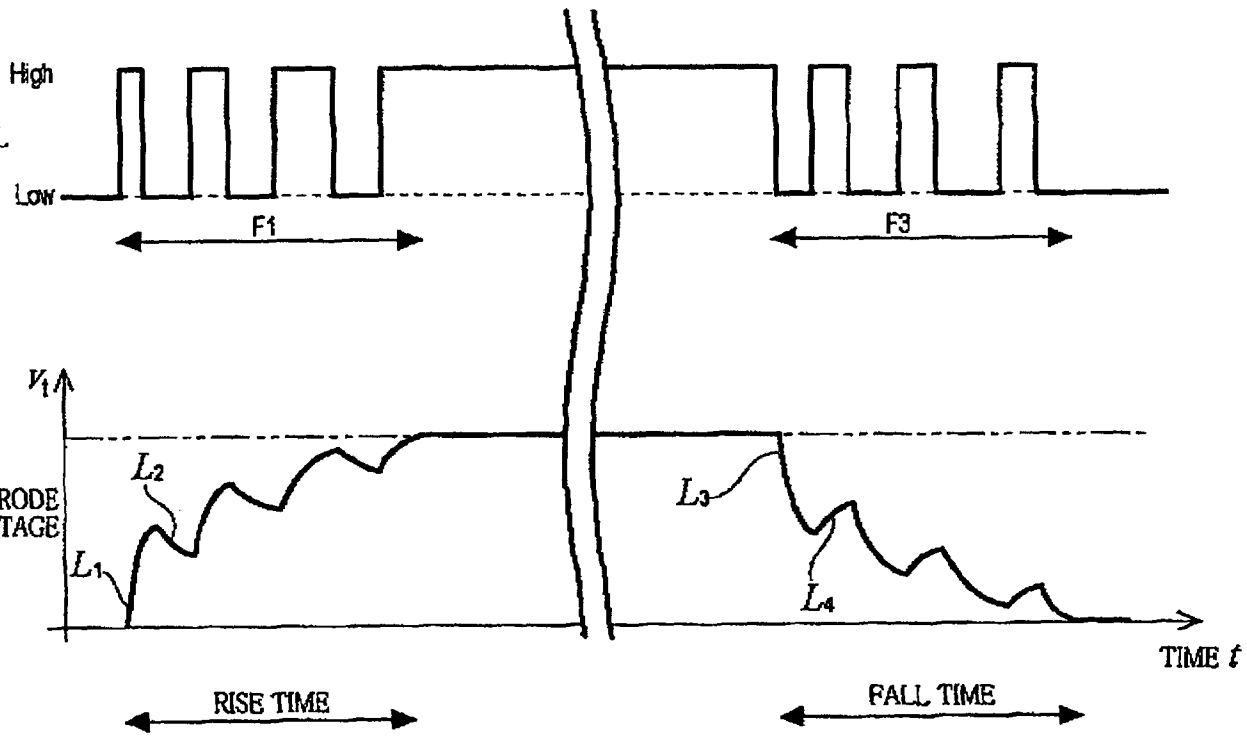
FIG. 10A is a timing chart, showing the drive signals of the driver circuit upon the electric charge and discharge operation of the piezoelectric element in a second modification.
FIG. 10B is a view corresponding to FIG. 10A and showing the time change of the interelectrode voltage of the piezoelectric element upon the electric charge and discharge operation of the piezoelectric element in the second modification.

The second modification will be explained with reference to FIG. 10A. The drive signals shown in FIG. 10A are the same as those in FIG. 8A, and an explanation of which is dispensed with. As shown in FIG. 10B, in a charging interelectrode voltage curve representing a time change of the interelectrode voltage Vt of the piezoelectric element 17 which corresponds to the charging waveform F1 in FIG. 10A, the rise portions $L_1$ each corresponding to the Hi level of the drive signal outputted when the electrode 17A and the HVDD terminal 13 are connected to each other and the nonrise portions $L_2$ each corresponding to the Lo level of the drive signal outputted when the electrode 17A and the ground 19 are connected to each other alternately appear. An inclination of the rise portion $L_1$ is steep just after the level of the drive signal is changed from the Lo level to the Hi level, but decreases with a lapse of time. In the nonrise portions $L_2$, the interelectrode voltage Vt is slightly decreases. Rise cycles each constituted by the rise portion $L_1$ and the nonrise portion $L_2$ continued therefrom and each corresponding to one pulse constituted by the Hi level and the Lo level of the drive signals appear in the charging interelectrode voltage curve. Here, in at least one of the second and subsequent rise cycles after the start of the electric charge, the time ratio of the rise portion $L_1$ to the nonrise portion $L_2$ is greater than that in the first cycle after the start of the electric charge.

Further, the fall cycles each corresponding to one pulse and each constituted by a corresponding one of the fall portions $L_3$ and a corresponding one of the nonfall portions $L_4$ which is continued therefrom appear in a discharging interelectrode voltage curve representing the time change of the interelectrode voltage Vt of the piezoelectric element 17 which corresponds to the discharging waveform F3 in FIG. 10A. The number of the fall cycles in the discharging interelectrode voltage curve corresponds to the number of the pulses in the discharging waveform F3. In at least one of the second and subsequent fall cycles after the start of the electric discharge, a time ratio of the fall portion $L_3$ to the nonfall portion $L_4$ is greater than that in the first fall cycle after the start of the electric discharge.

Also in this second modification, the interelectrode voltage Vt of the piezoelectric element 17 is increased stepwise in the transition period in which the interelectrode voltage of the piezoelectric element 17 rises from the ground level to the reference voltage level. Thus, it is possible to prevent the sudden change of the interelectrode voltage Vt of the piezoelectric element 17. Further, the interelectrode voltage Vt of the piezoelectric element 17 is reduced stepwise in the transition period in which the interelectrode voltage of the piezoelectric element 17 falls from the reference voltage level to the ground level. Thus, it is possible to prevent the sudden change of the interelectrode voltage Vt of the piezoelectric element 17. This makes it possible to prevent the misejection from the ink ejection head 31.

Second Embodiment

In the charging waveform F1 and the discharging waveform F3 of in the above-described first embodiment, "t" of "(t/CR)" in the formula (1) is changed. However, "R" of "(t/CR)" in the formula (1) may be changed in the charging waveform F1 and the discharging waveform F3 instead of "t". There will be explained a second embodiment where the driver circuit 11 of the piezoelectric element 17 is operated so as to change "R" in the charging waveform F1 and the discharging waveform F3 with reference to FIG. 11.

Figure 11:
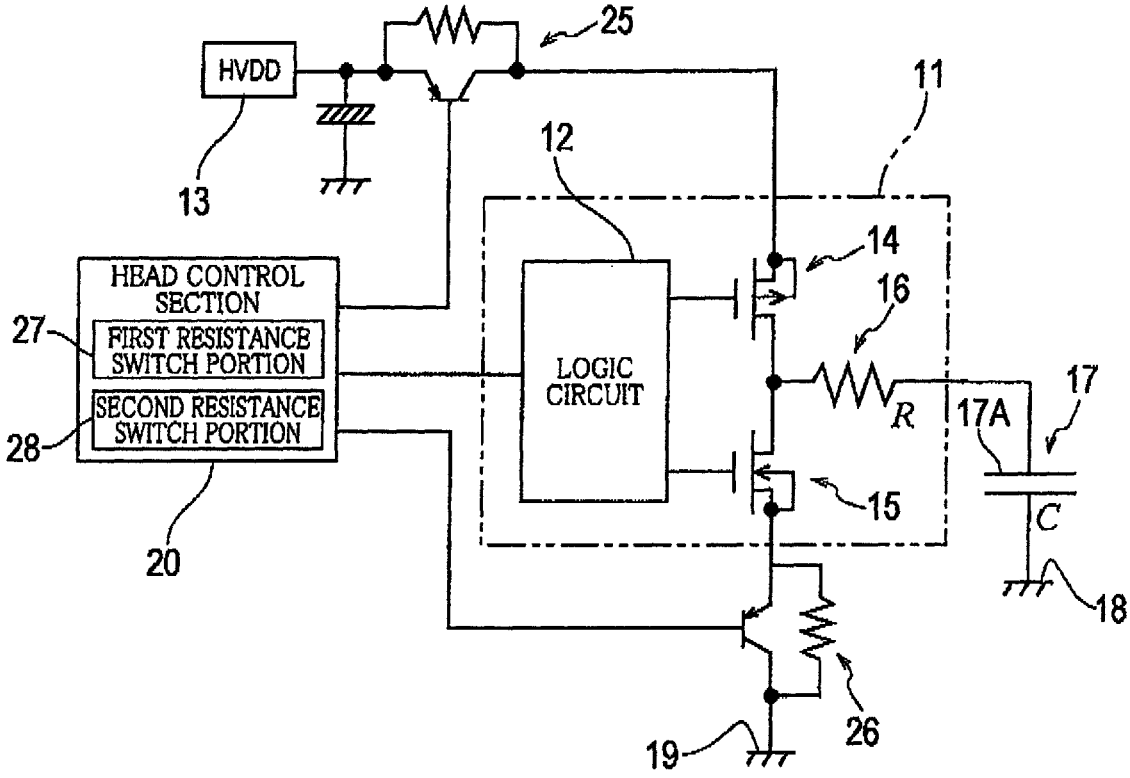
FIG. 11 is a circuit diagram of a drive structure of a piezoelectric element in a second embodiment of the present invention.

As shown in FIG. 11, a drive structure of a piezoelectric element in this second embodiment is generally the same as that in the first embodiment, but this second embodiment is different from the first embodiment in that a first current limit resistor 25 and a second current limit resistor 26 are provided. Thus, in the following explanation of the drive structure of the piezoelectric element in the second embodiment, the first current limit resistor 25 and the second current limit resistor 26 will be explained in detail, and an overlapping explanation is omitted.

The first current limit resistor 25 is provided on a signal line connecting between the source terminal of the ON-side FET 14 and the HVDD terminal 13 and configured to limit a current flowing from the power source to the electrode 17A of the piezoelectric element 17. A limitation state in which the current flow from the power source to the electrode 17A is limited by the first current limit resistor 25 and a limitation release state in which the limitation is released (that is, the current flow from the power source to the electrode 17A is not limited) are switched by a first resistance switch portion 27 as one example of first and third resistance switch portions. The second current limit resistor 26 is provided on a signal line connecting between the source terminal of the OFF-side FET 15 and the ground and is configured to limit a current flowing from the electrode 17A of the piezoelectric element 17 to the ground. A limitation state in which the current flow from the electrode 17A to the ground is limited by the second current limit resistor 26 and a limitation release state in which the limitation is released (that is, the current flow from the electrode 17A to the ground is not limited) are switched by a second resistance switch portion 28 as one example of second and fourth resistance switch portions.

Figures 12A, 12B:
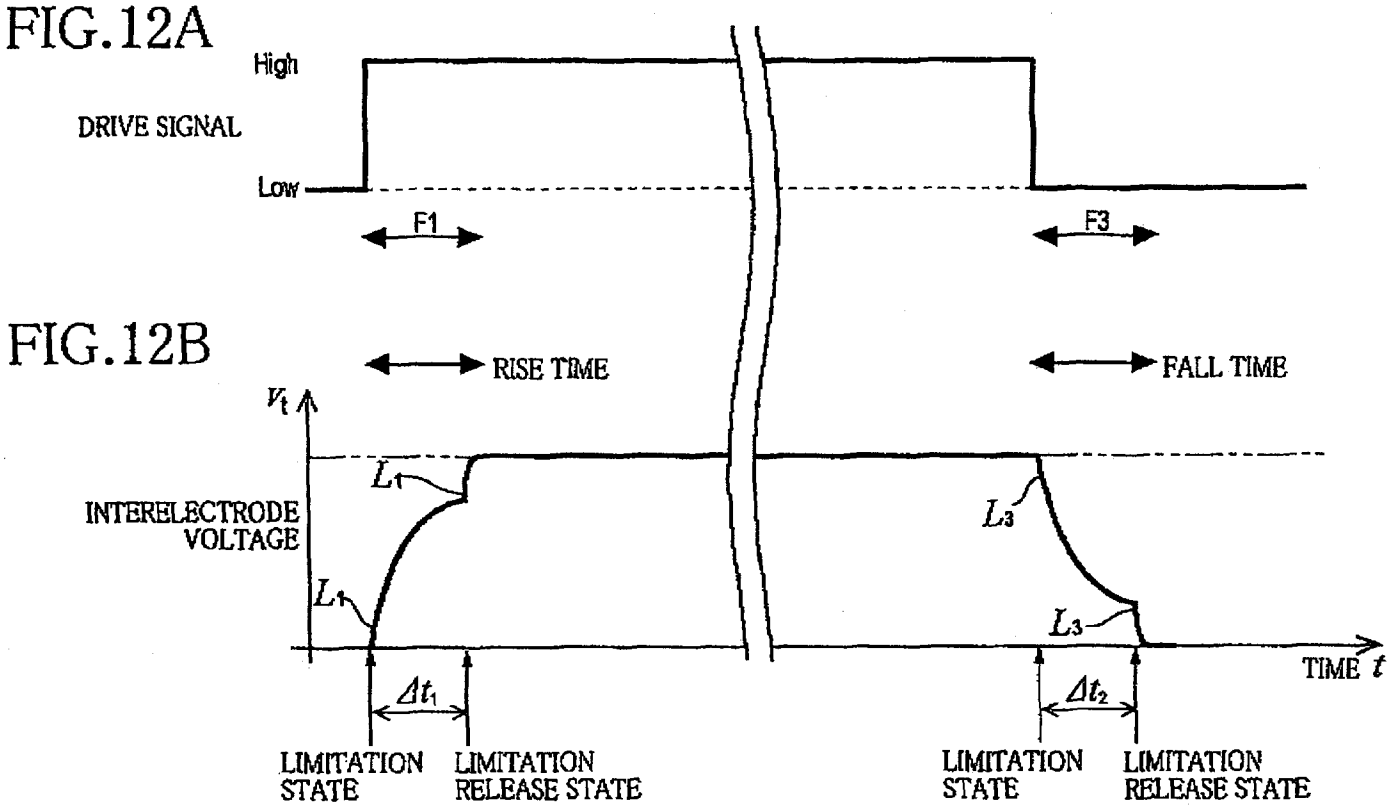
FIG. 12A is a timing chart showing drive signals of a driver circuit upon an electric charge and discharge operation of a piezoelectric element in the second embodiment.
FIG. 12B is a view corresponding to FIG. 12A and showing a time change of an interelectrode voltage of the piezoelectric element upon the electric charge and discharge operation of the piezoelectric element in the second embodiment.

As shown in FIG. 12A, the charging waveform F1 is one pulse wave in which the level of the drive signal is changed from the Lo level to the Hi level upon the start of the electric charge and kept at the Hi level. The first current limit resistor 25 is changed to the limitation state upon or before the start of the electric charge. After a predetermined time $\Delta t_1$ has passed from the timing when the level of the drive signal has been changed to the Hi level, the first current limit resistor 25 is changed to the limitation release state. Here, the predetermined time $\Delta t_1$ is an extremely short length of time in which the interelectrode voltage Vt of the piezoelectric element 17 does not reach the reference voltage level after the start of the electric charge. As thus described, the state in which the current flowing from the power source to the electrode 17A of the piezoelectric element 17 is limited is changed to the state in which the limitation is released, in the electric charge of the piezoelectric element 17. Thus, as shown in FIG. 12B, two rise portions $L_1$ continuously appear in the charging interelectrode voltage curve.

A resistance value of the first current limit resistor 25 and the time $\Delta t_1$ are set such that the rise time is made as short as possible within a range in which the misejection does not occur. For example, where the resistance value of the first current limit resistor 25 is relatively large, an inclination of a first rise portion $L_1$ appearing in the charging interelectrode voltage curve after the start of the electric charge is less steep than in a case where the resistance value of the first current limit resistor 25 is relatively small, and thus the time $\Delta t_1$ needs to be made relatively short. In reality, optimal value of the resistance value of the first current limit resistor 25 and the time $\Delta t_1$ are obtained by surveying a pressure in the individual ink channel 90 and a state of the misejection by a theoretical calculation or an actual measurement. Since the current flowing from the power source to the electrode 17A as one of the electrodes of the piezoelectric element 17 is limited by the first current limit resistor 25 before the time $\Delta t_1$ passes from the start of the electric charge, the inclination of the rise portion $L_1$ appearing first in the charging interelectrode voltage curve after the start of the electric charge is gentle when compared with the state in which the limitation is released. After the time $\Delta t_1$ passes from the start of the electric charge, the first current limit resistor 25 does not limit the current flow. However, since the interelectrode voltage of the piezoelectric element 17 is nearer to the reference voltage level than the rise portion $L_1$ appearing first in the charging interelectrode voltage curve after the start of the electric charge, the sudden change of the interelectrode voltage Vt is suppressed.

As shown in FIG. 12A, the discharging waveform F3 is one pulse wave in which the level of the drive signal is changed from the Hi level to the Lo level upon the start of the electric discharge. The second current limit resistor 26 is changed to the limitation state upon or before the start of the electric discharge. After a predetermined time $\Delta t_2$ has passed from the timing when the level of the drive signal has been changed to the Lo level, the second current limit resistor 26 is changed to the limitation release state. Here, the predetermined time $\Delta t_2$ is an extremely short length of time in which the interelectrode voltage Vt of the piezoelectric element 17 does not reach the ground level after the start of the electric discharge. As thus described, the state in which the current flowing from the electrode 17A of the piezoelectric element 17 to the ground is limited is changed to the state in which the limitation is released, in the electric discharge of the piezoelectric element 17. Thus, as shown in FIG. 12B, two fall portions $L_3$ continuously appear in the discharging interelectrode voltage curve. Here, the resistance value of the second current limit resistor 26 and the time $\Delta t_2$ are set in the same manner as the resistance value of the that current limit resistor 25 and the time $\Delta t_1$. Since the current flowing from the electrode 17A as one of the electrodes of the piezoelectric element 17 to the ground 19 is limited by the second current limit resistor 26 before the time $\Delta t_2$ passes from the start of the electric discharge, the inclination of the fall portion $L_3$ appearing first in the discharging interelectrode voltage curve after the start of the electric discharge is gentle when compared with the state in which the limitation is released. After the time $\Delta t_2$ passes from the start of the electric discharge, the second current limit resistor 26 does not limit the current flow. However, since part of the electric charge of the piezoelectric element 17 has already been discharged, the sudden change of the interelectrode voltage Vt is suppressed.

Meanwhile, from the viewpoint of suppressing the sudden change of the interelectrode voltage Vt of the piezoelectric element 17, the order of the limitation state and the limitation release state of the first current limit resistor 25 and the second current limit resistor 26 may be reversed from the above-described order. This alternative configuration will be explained as a third modification of the above-described embodiment with reference to FIGS. 13A and 13B.

Third Modification

Figures 13A, 13B:
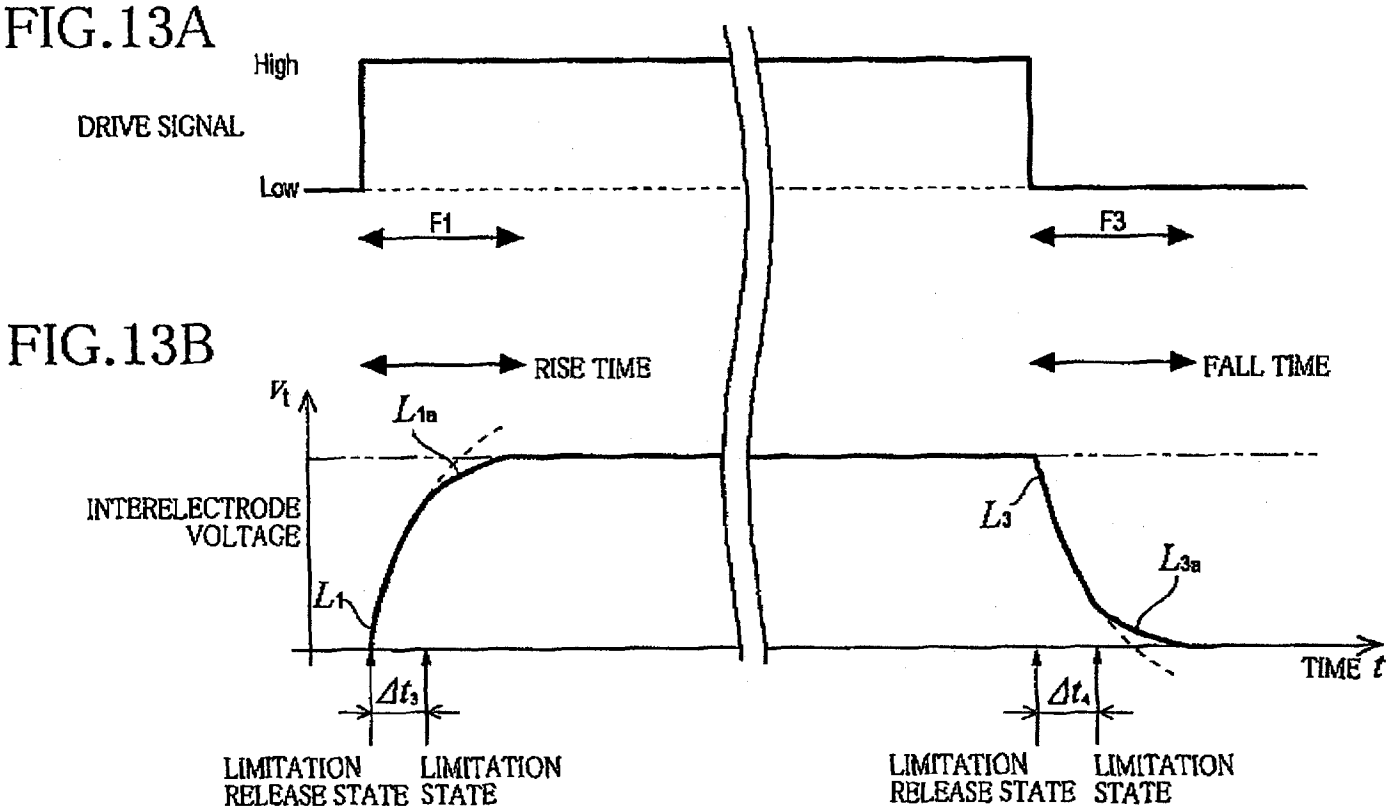
FIG. 13A is a timing chart showing the drive signals of the driver circuit upon the electric charge and discharge operation of the piezoelectric element in a third modification.
FIG. 13B is a view corresponding to FIG. 13A and showing the time change of the interelectrode voltage of the piezoelectric element upon the electric charge and discharge operation of the piezoelectric element in the third modification.

As shown in FIG. 13A, the charging waveform F1 is one pulse wave in which the level of the drive signal is changed from the Lo level to the Hi level upon the start of the electric charge and kept at the Hi level. The first current limit resistor 25 is changed to the limitation release state upon or before the start of the electric charge. After a predetermined time $\Delta t_3$ has passed from the timing when the level of the drive signal has been changed to the Hi level, the first current limit resistor 25 is changed to the limitation state. Here, the predetermined time $\Delta t_3$ is an extremely short length of time in which the interelectrode voltage Vt of the piezoelectric element 17 does not reach the reference voltage level after the start of the electric charge. As thus described, the state in which the current flowing from the power source to the electrode 17A of the piezoelectric element 17 is limited is changed to the state in which the limitation is released, in the electric charge of the piezoelectric element 17. Thus, as shown in FIG. 13B, two rise portions $L_1$, $L_{1a}$ continuously appear in the charging interelectrode voltage curve. Where the driver circuit 11 is operated in this manner, the current flowing from the power source to the electrode 17A as one of the electrodes of the piezoelectric element 17 is limited after the predetermined time $\Delta t_3$ passes from the start of the electric charge. Thus, it is possible to suppress an increase in the interelectrode voltage Vt in the rise portion $L_{1a}$ in the charging interelectrode voltage curve. As a result, the sudden change of the interelectrode voltage of the piezoelectric element 17 can be suppressed.

As shown in FIG. 13A, the discharging waveform F3 is one pulse wave in which the level of the drive signal is changed from the Hi level to the Lo level upon the start of the electric discharge. The second current limit resistor 26 is changed to the limitation release state upon or before the start of the electric discharge. After a predetermined time $\Delta t_4$ has passed from the timing when the level of the drive signal has been changed to the Lo level, the second current limit resistor 26 is changed to the limitation state. Here, the predetermined time $\Delta t_4$ is an extremely short length of time in which the interelectrode voltage Vt of the piezoelectric element 17 does not reach the ground level after the start of the electric discharge. As thus described, the state in which the current flowing from the electrode 17A of the piezoelectric element 17 to the ground 19 is limited is changed to the state in which the limitation is released, in the electric discharge of the piezoelectric element 17. Thus, as shown in FIG. 13B, two fall portions $L_3$, $L_{3a}$ continuously appear in a curve representing the time change of the interelectrode voltage Vt of the piezoelectric element 17. Where the driver circuit 11 is operated in this manner, the current flowing from the piezoelectric element 17 to the ground 19 is limited by the second current limit resistor 26 after the predetermined time $\Delta t_4$ passes from the start of the electric discharge. Thus, it is possible to suppress a decrease in the interelectrode voltage Vt in the fall portion $L_{3a}$ in the curve of the interelectrode voltage Vt. As a result, the sudden change of the interelectrode voltage Vt of the piezoelectric element 17 can be suppressed.

Fourth Modification

Figure 14:
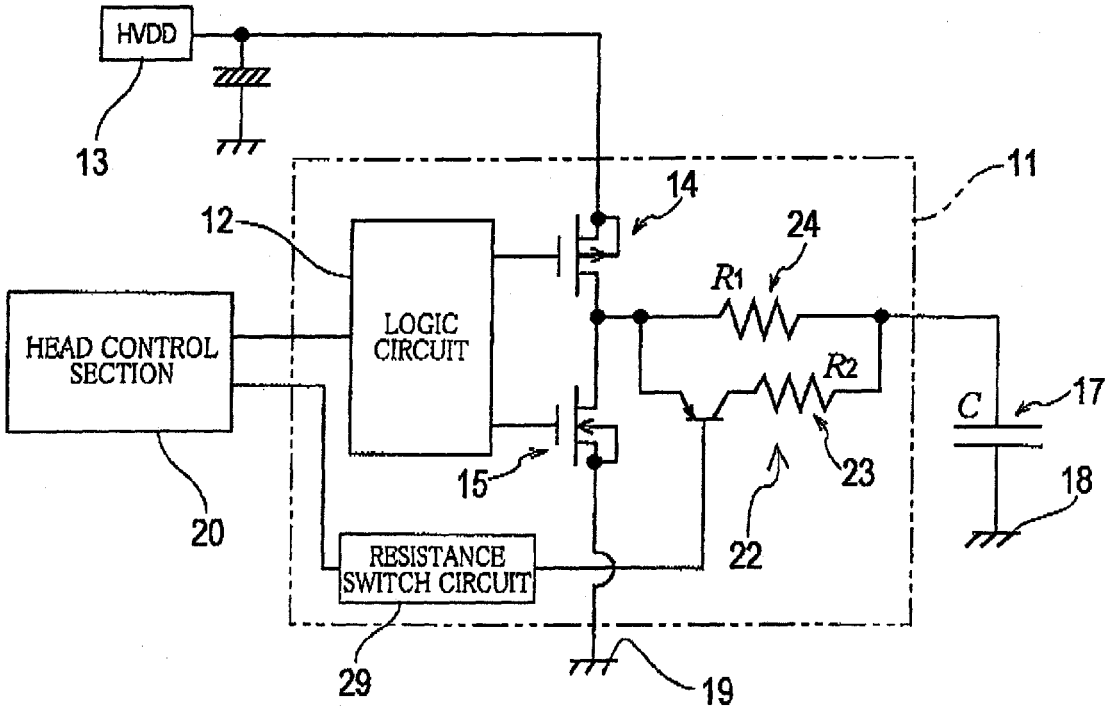
FIG. 14 is a circuit diagram of a drive structure of the piezoelectric element in a fourth modification.
Figure 15:
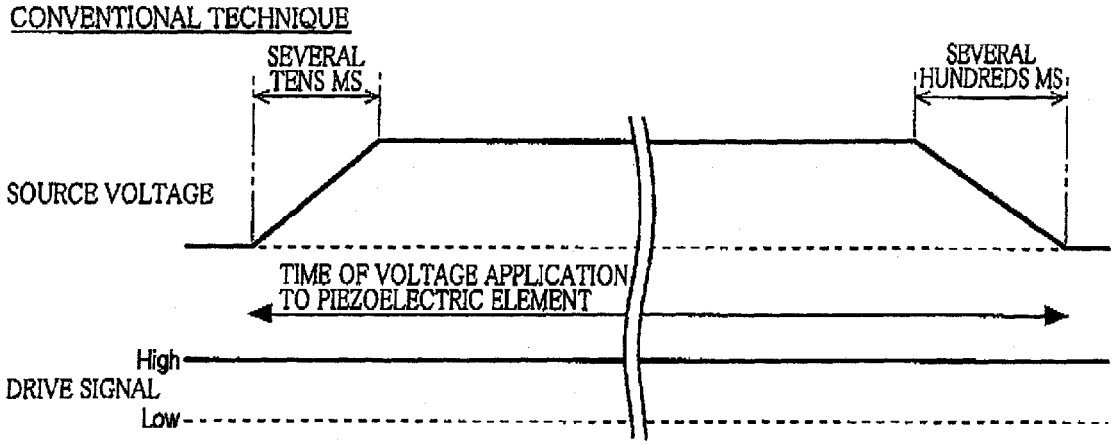
FIG. 15 is a timing chart showing one example of a source voltage and drive signals of a conventional piezoelectric element upon an electric charge and discharge operation.
Figure 16A:
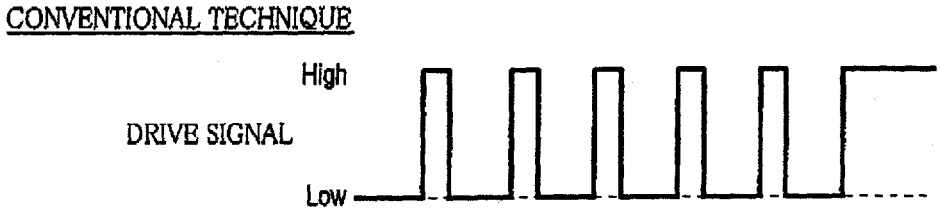
Figure 16B:
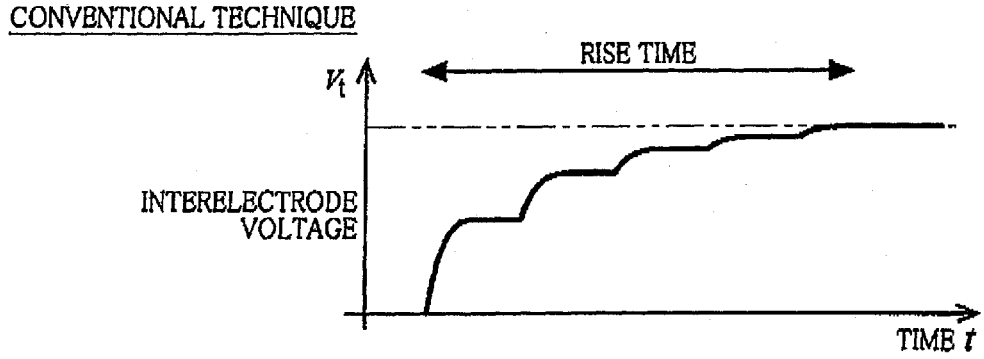

The arrangement and configuration of the resistor(s) for changing "R" of "(t/CR)" in the formula (1) are not limited to the above-described ones. For example, a resistance(s) may be provided inside the driver circuit 11. There will be explained an alternative configuration in which resistances are provided in the driver circuit 11 as a fourth modification of the above-described embodiment with reference to FIG. 14.

In this fourth modification, the structure of the driver circuit 11 is generally the same as that of the driver circuit 11 shown in FIG. 6 (in the first embodiment), but this fourth modification is different from the first embodiment in that the drive circuit 11 includes a variable resistor 22 comprised of a first resistor 24 and a second resistor 23 connected to each other in parallel instead of the resistor 16. A state of the variable resistor 22 is changed by the control of the head control section 20 between a high resistance state (a resistance value R1 of the first resistor 24) and a low resistance state (a combined resistance value of the resistance value R1 of the first resistor 24 and a resistance value R2 of the second resistor 23). The switch of the resistance value (state) of the variable resistor 22 is performed by a resistance switch circuit 29 as one example of the first-fourth resistance switch portions. This variable resistor 22 can limit the current flowing from the power source to the electrode 17A upon the electric charge of the piezoelectric element 17 and can limit the current flowing from the electrode 17A to the ground upon the electric discharge of the piezoelectric element 17.

In the drive structure of the piezoelectric element in this fourth, modification, as shown in FIGS. 12A and 12B, in the electric charge of the piezoelectric element 17, the level of the drive signal is changed from the Lo level to the Hi level upon the start of the electric charge, and the variable resistor 22 is changed to the high resistance state upon or before the start of the electric charge. After the predetermined time $\Delta t_1$ passes from the timing when the level of the drive signal has been changed to the Hi level, the variable resistor 22 is changed to the low resistance state. In the electric discharge of the piezoelectric element 17, the level of the drive signal is changed from the Hi level to the Lo level upon the start of the electric discharge, and the variable resistor 22 is changed to the high resistance state upon or before the start of the electric discharge. After the predetermined time $\Delta t_2$ passes from the timing when the level of the drive signal has been changed to the Lo level, the variable resistor 22 is changed to the low resistance state.

Alternatively, in the drive structure of the piezoelectric element in this fourth modification, as shown in FIGS. 13A and 13B, in the electric charge of the piezoelectric element 17, the level of the drive signal is changed from the Lo level to the Hi level upon the start of the electric charge, and the variable resistor 22 is changed to the low resistance state upon or before the start of the electric charge. After the predetermined time $\Delta t_3$ passes from the timing when the level of the drive signal has been changed to the Hi level, the variable resistor 22 is changed to the high resistance state. In the electric discharge of the piezoelectric element 17, the level of the drive signal is changed from the Hi level to the Lo level upon the start of the electric discharge, and the variable resistor 22 is changed to the low resistance state upon or before the start of the electric discharge. After the predetermined time $\Delta t_4$ passes from the timing when the level of the drive signal has been changed to the Lo level, the variable resistor 22 is changed to the high resistance state.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

It is noted that, in the above-described embodiments, the time ratio of the rise portion to the nonrise portion in the first and subsequent rise cycles after the start of the charge control increases with a lapse of time, but the present invention is not limited to this configuration. For example, the time ratio of the rise portion to the nonrise portion in any of the second and subsequent rise cycles may be greater than the time ratio of the rise portion to the nonrise portion in the first rise cycle. Further, the drive circuit 11 may be configured such that the time ratio of the rise portion to the nonrise portion in the second rise cycle is less than the time ratio of the rise portion to the nonrise portion in the first rise cycle, and the time ratio of the rise portion to the nonrise portion in any of the third and subsequent rise cycles may be greater than the time ratio of the rise portion to the nonrise portion in the first rise cycle.

In the above-described embodiments, the time ratio of the fall portion to the nonfall portion in the first and subsequent fall cycles after the start of the discharge control increases with a lapse of time, but the present invention is not limited to this configuration. For example, the time ratio of the fall portion to the nonfall portion in any of the second and subsequent fall cycles may be greater than the time ratio of the fall portion to the nonfall portion in the first fall cycle. Further, the drive circuit 11 may be configured such that the time ratio of the fall portion to the nonfall portion in the second fall cycle is less than the time ratio of the fall portion to the nonfall portion in the first fall cycle, and the time ratio of the fall portion to the nonfall portion in any of the third and subsequent fall cycles may be greater than the time ratio of the fall portion to the nonfall portion in the first fall cycle.

In the above-described embodiments, as shown in FIGS. 8A and 8B, for example, the time ratio of the rise portion to the nonrise portion in the second and subsequent rise cycles is greater than the time ratio of the rise portion to the nonrise portion in the first rise cycle in the charge control, and the time ratio of the fall portion to the nonfall portion in the second and subsequent fall cycles is greater than the time ratio of the fall portion to the nonfall portion in the first fall cycle in the discharge control. However, the time ratio in the second and subsequent cycles may not be greater than the time ratio in the first fall cycle in both of the charge control and the discharge control. For example, the drive circuit 11 may be configured such that the time ratio of the rise portion to the nonrise portion in the second and subsequent rise cycles is greater than the time ratio of the rise portion to the nonrise portion in the first rise cycle in the charge control, and the time ratios of the fall portions to the nonfall portions in all the respective fall cycles are the same as one another in the discharge control. Alternatively, the drive circuit 11 may be configured such that the time ratios of the rise portions to the nonrise portions in all the respective rise cycles are the same as one another in the charge control, and the time ratio of the fall portion to the nonfall portion in the second and subsequent fall cycles is greater than the time ratio of the fall portion to the nonfall portion in the first fall cycle in the discharge control. These alternative configurations can be applied to the first modification and the second modification.

In the above-described embodiments, the explanation has been made for the drive circuit for the piezoelectric element included in the ink ejection head 31 in the ink-jet printer 1 for ejecting the ink droplet and the method for driving the piezoelectric element, but the present invention is not limited to these examples. For example, the liquid droplet ejected from the liquid-droplet ejection head may be a liquid droplet of treatment liquid used, e.g., for speedily fixing the ink droplet on the recording sheet. Further, the present invention is applicable to several applications using the ink-jet method such as an application of a material for forming an orientation layer of a liquid crystal display element, an application of a flux, and an application of an adhesive as in the manner described above.

What is claimed is:

1. A method for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the method comprising:

a first step of increasing a voltage of a power source to a reference voltage level; and a second step of charging one electrode of the two electrodes to the reference voltage level by repeating a plurality of source-connections and a plurality of source-disconnections between the power source and the one electrode while keeping the voltage of the power source at the reference voltage level, such that a ratio of a connection time of each of at least one of second and subsequent connections of the plurality of source-connections to a disconnection time of a corresponding one of at least one of the plurality of source-disconnections which one is continued from said each of the at least one of the second and subsequent connections is greater than a ratio of a connection time of a first connection of the plurality of source-connections to a disconnection time of a disconnection of the plurality of source-disconnections which is continued from the first connection.

2. The method for driving the piezoelectric element according to claim 1, wherein the second step is a step of charging the one electrode to the reference voltage level by a single charge operation including both of the first connection and at least one of the second and subsequent connections.

3. The method for driving the piezoelectric element according to claim 1, further comprising a third step of discharging the one electrode charged to the reference voltage level to a ground level by repeating a plurality of ground-connections and a plurality of ground-disconnections between the one electrode and a ground such that a ratio of a connection time of each of at least one of second and subsequent connections of the plurality of ground-connections to a disconnection time of a corresponding one of the plurality of ground-disconnections which is continued from said each of the at least one of the second and subsequent connections of the plurality of ground-connections is greater than a ratio of a connection time of a first connection of the plurality of ground-connections to a disconnection time of a disconnection of the plurality of ground-disconnections which is continued from the first connection of the plurality of ground-connections.

4. The method for driving the piezoelectric element according to claim 3, wherein the third step is a step of discharging the one electrode to the ground level by a single discharge operation including both of the first connection and at least one of the second and subsequent connections between the ground and the one electrode.

5. The method for driving the piezoelectric element according to claim 1, wherein the second step is a step of connecting the one electrode to the power source at several times while gradually increasing the connection time of the source-connection between the one electrode and the power source.

6. The method for driving the piezoelectric element according to claim 3, wherein the third step is a step of connecting the one electrode to the ground at several times while gradually increasing the connection time of the ground-connection between the one electrode and the ground.

7. The method for driving the piezoelectric element according to claim 1, wherein the second step is a step of connecting the one electrode to the power source at several times while gradually reducing the disconnection time of the source-disconnection between the one electrode and the power source and while keeping the connection time of the source-connection between the one electrode and the power source constant.

8. The method for driving the piezoelectric element according to claim 3, wherein the third step is a step of connecting the one electrode to the ground at several times while gradually reducing the disconnection time of the ground-disconnection between the one electrode and the ground and while keeping the connection time of the ground-connection between the one electrode and the ground constant.

9. A drive circuit for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the drive circuit comprising:

a first switch element configured to connect one electrode of the two electrodes to a power source of a reference voltage level when a first drive signal is ON and configured to disconnect the one electrode from the power source when the first drive signal is OFF; and a charge controller configured to generate the first drive signal for charging the one electrode to the reference voltage level by repeating a plurality of source-connections and a plurality of source-disconnections between the power source and the one electrode such that a ratio of a connection time of each of at least one of second and subsequent connections of the plurality of source-connections to a disconnection time of a corresponding one of the plurality of source-disconnections which is continued from said each of the at least one of the second and subsequent connections is greater than a ratio of a connection time of a first connection of the plurality of source-connections to a disconnection time of a disconnection of the plurality of source-disconnections which is continued from the first connection, the charge controller being configured to transmit the generated first drive signal to the first switch element.

10. The drive circuit for the piezoelectric element according to claim 9, wherein the charge controller is configured to generate the first drive signal for charging the one electrode to the reference voltage level by a single charge operation including both of the first connection and at least one of the second and subsequent connections.

11. The drive circuit for the piezoelectric element according to claim 9, further comprising:

a second switch element configured to connect the one electrode to a ground when a second drive signal is OFF and configured to disconnect the one electrode from the ground when the second drive signal is ON; and a discharge controller configured to generate the second drive signal for discharging the one electrode charged to the reference voltage level to a ground level by repeating a plurality of ground-connections and a plurality of ground-disconnections between the one electrode and the ground such that a ratio of a connection time of each of at least one of second and subsequent connections of the plurality of ground-connections to a disconnection time of a corresponding one of the plurality of ground-disconnections which is continued from said each of the at least one of the second and subsequent connections of the plurality of ground-connections is greater than a ratio of a connection time of a first connection of the plurality of ground-connections to a disconnection time of a disconnection therebetween which is continued from the first connection of the plurality of ground-connections, the discharge controller being configured to transmit the generated second drive signal to the second switch element.

12. The drive circuit for the piezoelectric element according to claim 11, wherein the discharge controller is configured to generate the second drive signal for discharging the one electrode to the ground level by a single discharge operation including both of the first connection and at least one of the second and subsequent connections between the ground and the one electrode.

13. The drive circuit for the piezoelectric element according to claim 9, wherein the drive signal is a plurality of pulse waves, and a pulse width modulation is performed for the plurality of pulse wave such that a duty ratio thereof gradually changes.

14. The drive circuit for the piezoelectric element according to claim 9, wherein the drive signal is a plurality of pulse waves, and a pulse frequency modulation is performed for the plurality of pulse waves such that the connection time of the source-connection between the one electrode and the power source is kept constant, and a time in which the one electrode and the power source are not connected to each other gradually changes.

15. A drive circuit for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the drive circuit comprising:

a third switch element configured to connect one electrode of the two electrodes to a power source of a reference voltage level when a drive signal is ON and configured to connect the one electrode to a ground when the drive signal is OFF; and a charge controller configured to generate the drive signal for charging the one electrode to the reference voltage level by repeating a plurality of source-connections between the power source and the one electrode and a plurality of ground-connections between the ground and the one electrode such that a ratio of a connection time of each of at least one of second and subsequent connections of the plurality of source-connections to a connection time of a corresponding one connection of the plurality of ground-connections which is continued from said each of the at least one of the second and subsequent connections is greater than a ratio of a connection time of a first connection of the plurality of source-connections to a connection time of a connection of the plurality of ground-connections which is continued from the first connection, the charge controller being configured to transmit the generated drive signal to the third switch element.

16. The drive circuit for the piezoelectric element according to claim 15, wherein the charge controller is configured to generate the drive signal for charging the one electrode to the reference voltage level by a single charge operation including both of the first connection and at least one of the second and subsequent connections between the power source and the one electrode.

17. The drive circuit for the piezoelectric element according to claim 15, wherein the charge controller is configured to generate the drive signal for discharging the one electrode charged to the reference voltage level to the ground level by repeating the plurality of ground-connections and the plurality of source-connections such that a ratio of a connection time of each of at least one of second and subsequent connections of the plurality of ground-connections to a connection time of a corresponding one of the plurality of source-connections which is continued from said each of the at least one of the second and subsequent connections of the plurality of ground-connections is greater than a ratio of a connection time of a first connection of the plurality of ground-connections to a connection time of a connection of the plurality of source-connections which is continued from the first connection of the plurality of ground-connections, the charge controller being configured to transmit the generated drive signal to the third switch element.

18. The drive circuit for the piezoelectric element according to claim 17, wherein the charge controller is configured to generate the drive signal for discharging the one electrode to the ground level by a single discharge operation including both of the first connection and at least one of the second and subsequent connections between the ground and the one electrode.

19. A liquid-droplet ejection head configured to apply a drive voltage to one of a plurality of piezoelectric elements to eject a liquid droplet through a corresponding one of a plurality of nozzles respectively corresponding to the plurality of piezoelectric elements, the liquid-droplet ejection head comprising:

the plurality of piezoelectric elements; and the drive circuit for the piezoelectric element according to claim 9 for driving the plurality of piezoelectric elements.

20. A method for driving a piezoelectric element of a liquid-droplet ejection head including: a plurality of piezoelectric elements each interposed between corresponding two electrodes of a plurality of electrodes; and a plurality of nozzles respectively corresponding to the plurality of piezoelectric elements, the liquid-droplet ejection head being configured to apply a drive voltage to one of the plurality of piezoelectric elements to eject a liquid droplet through a corresponding one of the plurality of nozzles, the method comprising: a step of discharging one electrode of the two electrodes which is charged to a reference voltage level to a ground level by repeating a plurality of ground-connections and a plurality of ground-disconnections between the one electrode and a ground such that a ratio of a connection time of each of at least one of second and subsequent connections of the plurality of ground-connections to a disconnection time of a corresponding one of the plurality of ground-disconnections which is continued from said each of the at least one of the second and subsequent connections is greater than a ratio of a connection time of a first connection of the plurality of ground-connections to a disconnection time of a disconnection of the plurality of ground-disconnections which is continued from the first connection.

* * * * *